US011541444B2

(12) United States Patent
Kohno

(10) Patent No.: US 11,541,444 B2
(45) Date of Patent: Jan. 3, 2023

(54) DIE CUSHION DEVICE OF PRESS MACHINE

(71) Applicant: AIDA ENGINEERING, LTD., Kanagawa (JP)

(72) Inventor: Yasuyuki Kohno, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 533 days.

(21) Appl. No.: 15/798,350

(22) Filed: Oct. 30, 2017

(65) Prior Publication Data

US 2018/0117656 A1 May 3, 2018

(30) Foreign Application Priority Data

Oct. 31, 2016 (JP) ..... JP2016-212898

(51) Int. Cl.
*B21D 24/02* (2006.01)
*B21D 24/10* (2006.01)
*B21D 24/14* (2006.01)

(52) U.S. Cl.
CPC ..... *B21D 24/02* (2013.01); *B21D 24/10* (2013.01); *B21D 24/14* (2013.01)

(58) Field of Classification Search
CPC ..... B21D 24/02; B21D 24/08; B21D 24/10; B21D 24/14; B30B 15/061; B30B 15/14; B30B 15/148; B30B 15/16; B30B 15/161; B30B 15/166; B30B 15/02; B30B 15/0076; B30B 15/165
See application file for complete search history.

(56) References Cited

U.S. PATENT DOCUMENTS 5,813,275 A * 9/1998 Kawakami ..... B21D 55/00 100/259
2008/0141668 A1* 6/2008 Micklisch ..... F15B 21/14 60/413
2009/0071218 A1 3/2009 Kohno et al.
(Continued)

FOREIGN PATENT DOCUMENTS

DE 20 2015 102613 U1 8/2015
JP 2006-315074 A 11/2006
WO 2010/058710 A1 5/2010

OTHER PUBLICATIONS

Extended European Search Report issued in corresponding EP Patent Application No. 17197500.6, dated Mar. 23, 2018.

*Primary Examiner* — Debra M Sullivan
(74) *Attorney, Agent, or Firm* — McDermott Will & Emery LLP

(57) ABSTRACT

A die cushion device of a press machine includes a hydraulic cylinder that supports a cushion pad and generates die cushion force when a slide of the press machine descends, an orifice and a hydraulic pump/motor that are connected to each other in in parallel between a lower chamber of the hydraulic cylinder and a tank, a servo motor connected to a rotating shaft of the hydraulic pump/motor, and a control unit that controls torque of the servo motor to control the die cushion force, wherein a rotation direction of the servo motor switches from a first rotation direction in which the hydraulic pump/motor serves as a hydraulic motor to a second rotation direction in which the hydraulic pump/motor serves as a hydraulic pump, during generation of the die cushion force.

13 Claims, 22 Drawing Sheets

(56) References Cited

U.S. PATENT DOCUMENTS

| | | | | |
|---|---|---|---|---|
| 2011/0226141 | A1* | 9/2011 | Kohno | B21D 24/14<br>100/269.01 |
| 2014/0090441 | A1* | 4/2014 | Knoche | B21D 24/02<br>72/372 |
| 2014/0208964 | A1* | 7/2014 | Kohno | B30B 1/265<br>100/35 |
| 2014/0260495 | A1* | 9/2014 | Kohno | B21D 22/20<br>72/347 |
| 2014/0366606 | A1* | 12/2014 | Kohno | G05B 19/46<br>72/453.18 |
| 2015/0185726 | A1* | 7/2015 | Kohno | B21D 24/02<br>72/21.5 |
| 2015/0360274 | A1 | 12/2015 | Kohno et al. | |
| 2016/0074920 | A1 | 3/2016 | Kohno | |

* cited by examiner

RELATED ART

FIG.16

| | WORKING DIE CUSHION PRESSURE (kg/cm²) | WORKING DIE CUSHION FORCE (kN) | SOLENOID VALVE 510N/OFF (ORIFICE DIAMETER 4.3mm) | SOLENOID VALVE 530N/OFF (ORIFICE DIAMETER 1.0mm) | SOLENOID VALVE 550N/OFF (ORIFICE DIAMETER 2.0mm) | AMOUNT OF OIL RELEASED FROM ORIFICE (l/min.) | ALLOWABLE MAXIMUM SLIDE SPEED (mm/s) (THEORETICAL VALUE) |
|---|---|---|---|---|---|---|---|
| (1) | 240.4 | 149.9754 | 1 | 0 | 0 | 119.8640198 | 628.3768726 |
| (2) | 220.4 | 137.4982 | 1 | 0 | 0 | 114.769741 | 615.0312822 |
| (3) | 200.4 | 125.0211 | 1 | 0 | 0 | 109.438584 | 601.0651368 |
| (4) | 180.4 | 112.5439 | 1 | 1 | 0 | 109.528943 | 601.3018522 |
| (5) | 160.4 | 100.0668 | 1 | 0 | 1 | 119.3889556 | 627.1323369 |
| (6) | 140.4 | 87.58962 | 1 | 0 | 1 | 111.698033 | 606.9842632 |
| (7) | 120.4 | 75.11247 | 1 | 1 | 1 | 108.0892549 | 597.5302707 |
| (8) | 100.4 | 62.63532 | 1 | 1 | 1 | 98.70431437 | 572.9443424 |
| (9) | 80.4 | 50.15816 | 1 | 1 | 1 | 88.32777775 | 545.7607088 |
| (10) | 60.4 | 37.68101 | 1 | 1 | 1 | 76.55750106 | 514.9258647 |
| (11) | 40.4 | 25.20385 | 1 | 1 | 1 | 62.61234395 | 478.3934401 |
| (12) | 20.4 | 12.7267 | 1 | 1 | 1 | 44.49224945 | 430.9238432 |

DIE CUSHION DEVICE OF PRESS MACHINE

CROSS-REFERENCE TO RELATED APPLICATIONS

The present application claims priority under 35 U.S.C. § 119 to Japanese Patent Application No. 2016-212898, filed on Oct. 31, 2016. The above application is hereby expressly incorporated by reference, in its entirety, into the present application.

BACKGROUND OF THE INVENTION

Field of the Invention

The present invention relates to a die cushion device of a press machine, and more particularly to a die cushion device of a press machine, capable of responding to speeding-up of a press machine.

Description of the Related Art

Conventionally, in a press machine including a die cushion device, there is known a die cushion device that controls hydraulic pressure (die cushion force) in a head-side hydraulic chamber of a hydraulic cylinder supporting a cushion pad by using a servo motor for driving a hydraulic pump/motor connected to the head-side hydraulic chamber (refer to Japanese Patent Application Laid-Open No. 2006-315074 (Patent Literature 1)).

The die cushion device described in Patent Literature 1 causes a hydraulic cylinder to be pressed down by a press slide (indirectly) in a die cushion force acting process, so that a rotation speed occurs in proportion to a slide speed in a servo motor.

Since a maximum rotation speed of a servo motor is limited (typically 2,000 to 3,000 [rpm]), a servo motor typically cannot be used at a slide maximum speed that can be generated by a press machine in many cases, and thus a corresponding slide speed is limited in many cases. This is a disadvantage in productivity that is one of features of a press machine.

Increase in capacity of a servo motor to improve the maximum rotation speed causes a problem of increasing cost.

Meanwhile, to solve a problem that speed of a servo motor is limited and a problem that cost increases with increase in capacity of a servo motor, there is suggested a die cushion device in which a hydraulic proportion flow control valve (or a servo valve) is used in combination with a servo motor (refer to International Publication No. WO 2010/058710 (Patent Literature 2)).

The die cushion device describe in Patent Literature 2 is configured such that a hydraulic pump/motor and a servo valve are connected to each other in parallel between a head-side hydraulic chamber (lower chamber) of a hydraulic cylinder and a low-pressure source to control torque of a servo motor connected to a rotating shaft of a hydraulic pump/motor, and that an opening of the servo valve is controlled to release a part of the amount of oil pushed away from the lower chamber of the hydraulic cylinder, when die cushion force acts, to the low-pressure source through the hydraulic pump/motor, and to release the remaining amount of oil to the low-pressure source through the servo valve.

SUMMARY OF THE INVENTION

The die cushion device described in Patent Literature 1 has a problem that it cannot be used as a die cushion device when a press slide moves at high speed to cause a rotation speed of the servo motor to exceed a maximum rotation speed (e.g., 3,000 [RPM]) and increase in capacity of the servo motor to be able to respond to speeding-up of a press slide results in increase in cost.

Meanwhile, the die cushion device described in Patent Literature 2 needs to control the servo motor and the servo valve in coordination with each other to control die cushion force (pressure), so that there is a problem that a control system is complicated to increase man-hours for adjustment of a machine, as well as to cause maintenance to be complicated.

The present invention is made in light of the above-mentioned circumstances, an object thereof is to provide a die cushion device of a press machine, the die cushion device being capable of responding to speeding-up of a press machine and preventing the device from being complicated and increasing in cost.

To achieve the object described above, a die cushion device of a press machine, according to an aspect of the present invention, includes a hydraulic cylinder that supports a cushion pad and generates die cushion force while a slide of the press machine descends, a throttle part and a hydraulic pump/motor that are connected to each other in parallel between a lower chamber of the hydraulic cylinder and a low-pressure source, an electric motor connected to a rotating shaft of the hydraulic pump/motor, and a control unit that controls torque of the electric motor to control the die cushion force. In the die cushion device, a rotation direction of the electric motor controlled in torque by the control unit switches from a first rotation direction in which the hydraulic pump/motor serves as a hydraulic motor to a second rotation direction in which the hydraulic pump/motor serves as a hydraulic pump, during generation of the die cushion force.

According to an aspect of the present invention, the amount of fluid pushed away from the lower chamber of the hydraulic cylinder can be released to a low-pressure source side through the throttle part and the hydraulic pump/motor when die cushion force acts, and particularly in a period where fluid pushed away from the lower chamber of the hydraulic cylinder is large in amount (a period where a slide moves at high speed), rotation speed of the electric motor connected to the rotating shaft of the hydraulic pump/motor can be greatly reduced as compared with a case where there is no throttle part. That is, it is possible to respond to speeding-up of a press machine (increase in allowable slide speed) by only adding a throttle part (without increasing manufacturing cost at all), without increasing capacity of an electric motor. In addition, the control unit controls torque of the electric motor to control die cushion force, but does not control throttle opening of the throttle part to control die cushion force, so that a control system is not complicated. Further, throttle opening of the throttle part is not controlled to control die cushion force, and thus when a slide comes close to the bottom dead center to cause fluid pushed away from the lower chamber of the hydraulic cylinder to be reduced in amount, a rotation direction of the electric motor switches from the first rotation direction in which the hydraulic pump/motor serves as a hydraulic motor to the second rotation direction in which the hydraulic pump/motor serves as a hydraulic pump. As a result, the amount of fluid (or die cushion force) released to the low-pressure source through the throttle part is maintained.

In a die cushion device of a press machine according to another aspect of the present invention, when a die cushion pressure command is uniform at least during generation of the die cushion force, the throttle part has a uniform throttle opening during the generation of the die cushion force. That is, when a die cushion pressure command is uniform, throttle opening during generation of die cushion force is also uniform, so that throttle opening of the throttle part is not changed.

In a die cushion device of a press machine according to yet another aspect of the present invention, a rotation direction of the electric motor is switched from the first rotation direction to the second rotation direction in at least a lower half region or less in one stroke of the cushion pad until the slide reaches the bottom dead center after colliding with the cushion pad. Speed of the slide greatly decreases in the lower half region or less in one stroke of the cushion pad as compared with speed of the slide when the slide collides with the cushion pad. When speed of the slide decreases (when fluid pushed away from the lower chamber of the hydraulic cylinder is reduced in amount), a rotation direction of the electric motor is switched from the first rotation direction to the second rotation direction, and then pressure fluid is supplied to the throttle part from the hydraulic pump/motor to maintain the amount of fluid (or die cushion force) released to the low-pressure source through the throttle part.

In a die cushion device of a press machine according to yet another aspect of the present invention, one or more of the hydraulic cylinders supporting the cushion pad are provided, and one or more of the hydraulic pump/motors and one or more of the electric motors are provided in each of the hydraulic cylinders.

In a die cushion device of a press machine according to yet another aspect of the present invention, the throttle part is an orifice or a throttle valve. The orifice or the throttle valve is used to have a uniform throttle opening during generation of die cushion force.

In a die cushion device of a press machine according to yet another aspect of the present invention, the throttle part includes a solenoid valve that is connected to the orifice or the throttle valve in series. The solenoid valve is opened only during generation of die cushion force, so that the orifice or the throttle valve can be used only during generation of die cushion force. In addition, when the solenoid valve is closed, the die cushion device can serve as a die cushion device substantially without a throttle part.

In a die cushion device of a press machine according to yet another aspect of the present invention, a plurality of the throttle parts is disposed in parallel between the lower chamber of the hydraulic cylinder and the low-pressure source.

In a die cushion device of a press machine according to yet another aspect of the present invention, the control unit causes the solenoid valve to open near a time when die cushion force starts acting, and causes the solenoid valve to close near a time when die cushion force stops acting. That is, the solenoid valve is opened only during generation of die cushion force, so that the orifice or the throttle valve can be used only during generation of die cushion force. Conversely, when the solenoid valve is closed in a period in a press stroke, other than during generation of die cushion force (die cushion position control period), the orifice or the throttle valve can be caused not to obstruct die cushion position control. Near a time when die cushion force starts acting, and near a time when die cushion force stops acting, respectively means a time when the slide collides with the cushion pad, and a time when the slide reaches the bottom dead center, including 0.2 second before and after each of the times. Response of the solenoid valve for opening/closing is considered to acquire 0.2 second.

In a die cushion device of a press machine according to yet another aspect of the present invention, the control unit causes one or more of the solenoid valves of the respective plurality of throttle parts provided to simultaneously open near a time when die cushion force starts acting, and causes the opened solenoid valve to simultaneously close near a time when die cushion force stops acting. One or more of the solenoid valves (the plurality of solenoid valves) of the respective plurality of throttle parts provided are selectively opened and closed to enable throttle opening of the throttle part to be substantially set.

In a die cushion device of a press machine according to yet another aspect of the present invention, the control unit causes one or more of the solenoid valves of the respective plurality of throttle parts provided to open near a time when die cushion force starts acting, and causes at least one of the solenoid valves opened to close or at least one of the solenoid valves closed to open, in accordance with change in a die cushion pressure command during die cushion force action, and then causes the solenoid valves opened to close near a time when die cushion force stops acting. The solenoid valve of at least one of the plurality of solenoid valves is opened and closed in accordance with change in die cushion pressure command during die cushion force action to enable the amount of fluid to be released to the low-pressure source through the throttle part to be changed.

In a die cushion device of a press machine according to yet another aspect of the present invention, the throttle part is a proportion flow control valve.

In a die cushion device of a press machine according to yet another aspect of the present invention, the control unit causes the proportion flow control valve closed near a time when die cushion force starts acting to have a uniform valve opening, and causes the proportion flow control valve to close near a time when die cushion force stops acting. While the proportion flow control valve is opened and closed near a time when die cushion force starts acting and near a time when die cushion force stops acting, respectively, the proportion flow control valve is not controlled in throttle opening during generation of die cushion force. That is, the control unit does not control throttle opening of the proportion flow control valve during generation of die cushion force, and controls torque of the electric motor to control die cushion force. The electric motor is only a control object to control die cushion force (pressure), so that a control system is not complicated even when a proportion flow control valve is used, man-hours for adjustment of a machine is not increased, and maintenance is not complicated. In addition, a proportion flow control valve can be steplessly adjusted for its throttle opening, so that the throttle opening can be adjusted to be suitable for die cushion force (pressure) to be set.

In a die cushion device of a press machine according to yet another aspect of the present invention, the control unit causes the proportion flow control valve closed near a time when die cushion force starts acting to have a uniform valve opening, and causes the valve opening of the proportion flow control valve to be changed during die cushion force action in accordance with change in a die cushion pressure command, and then causes the proportion flow control valve to close near a time when die cushion force stops acting. While valve opening of the proportion flow control valve is also changed during die cushion force action, the valve opening of the proportion flow control valve is changed in accordance with change in a die cushion pressure command changed during die cushion force action (valve opening is not changed to control die cushion force), so that a control system is not complicated.

A die cushion device of a press machine according to yet another aspect of the present invention includes a die cushion pressure command unit that outputs a preset die cushion pressure command, a pressure detector that detects pressure in the lower chamber of the hydraulic cylinder, and a flow rate detector that directly or indirectly detects a flow rate of pressure fluid that contains a part of pressure fluid pushed away from the lower chamber of the hydraulic cylinder, and that is released to the low-pressure source through the throttle part. In the die cushion device, the control unit controls torque of the electric motor on the basis of the die cushion pressure command, pressure detected by the pressure detector, and a flow rate detected by the flow rate detector such that die cushion pressure becomes pressure corresponding to the die cushion pressure command. The amount of fluid released to the low-pressure source through the throttle part is in proportion to a square root of die cushion pressure according to Bernoulli's theorem, so that the hydraulic pump/motor controlled in torque by the electric motor, and the throttle part, are used in combination with each other to contribute greatly to reduction in surge pressure (overshoot) in die cushion pressure. The flow rate detector may directly detect a flow rate of pressure fluid released to the low-pressure source through the throttle part, or may calculate (indirectly detect) the flow rate on the basis of die cushion pressure and throttle opening of the throttle part according to Bernoulli's theorem. Using a flow rate detected by the flow rate detector enables pressure accuracy in die cushion pressure control to be improved.

A die cushion device of a press machine according to yet another aspect of the present invention further includes a slide speed detector that detects speed of the slide, an angular speed detector that detects angular speed of the electric motor. In the die cushion device, the control unit controls torque of the electric motor such that die cushion pressure becomes pressure corresponding to the die cushion pressure command during die cushioning action of the press machine on the basis of the die cushion pressure command, pressure detected by the pressure detector, flow rate detected by the flow rate detector, speed detected by the slide speed detector, and angular speed detected by the angular speed detector. Using slide speed detected by the slide speed detector enables pressure accuracy in die cushion pressure control to be secured. In addition, using angular speed detected by the angular speed detector enables dynamic stability in die cushion pressure control to be secured.

In a die cushion device of a press machine according to yet another aspect of the present invention, when speed of the slide at the time when die cushion force starts acting is a predetermined speed or less, the throttle part is fully closed during generation of the die cushion force. When speed of the slide at the time when die cushion force starts acting is a predetermined speed or less, and all of the amount of fluid pushed away from the lower chamber of the hydraulic cylinder can be released to the low-pressure source through the hydraulic pump/motor, it is preferable that the throttle part is fully closed to cause pressure fluid not to be released to the low-pressure source through the throttle part.

According to the present invention, the amount of fluid pushed away from the lower chamber of the hydraulic cylinder is released to a low-pressure source side through the throttle part and the hydraulic pump/motor when die cushion force acts, so that particularly in a period where fluid pushed away from the lower chamber of the hydraulic cylinder is large in amount, rotation speed of the electric motor connected to the rotating shaft of the hydraulic pump/motor can be greatly reduced as compared with a case where there is no throttle part. As a result, it is possible to respond to speeding-up of a press machine (speeding-up of allowable slide speed) by only adding a throttle part without increasing capacity of the electric motor (without increasing manufacturing cost at all).

In addition, the control unit controls torque of the electric motor to control die cushion force, but does not control throttle opening of the throttle part to control die cushion force control, so that a control system cannot be complicated and increase in cost can be reduced.

Further, the amount of fluid released to the low-pressure source through the throttle part is in proportion to a square root of die cushion pressure according to Bernoulli's theorem, so that the hydraulic pump/motor controlled in torque by the electric motor, and the throttle part, are used in combination with each other to contribute greatly to reduction in surge pressure (overshoot) in die cushion pressure.

BRIEF DESCRIPTION OF THE DRAWINGS

FIG. 16 is a table illustrating die cushion force (pressure), and release flow rate and allowable maximum slide speed for each solenoid valve when turned on or tuned off;

DETAILED DESCRIPTION OF THE EMBODIMENTS

With reference to accompanying drawings, embodiments of a die cushion device of a press machine, according to the present invention, will be described below in detail.

[Principle of the Present Invention]

First, the present invention will be described in principle with reference to FIGS. 1 to 3.

Figure 1:
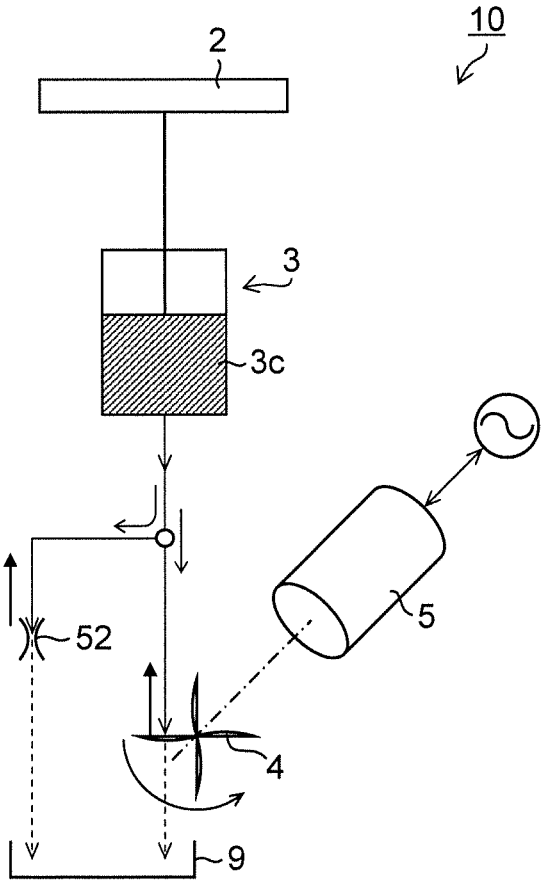
FIG. 1 is a schematic view of a die cushion device of a press machine, according to the present invention.
Figure 2:
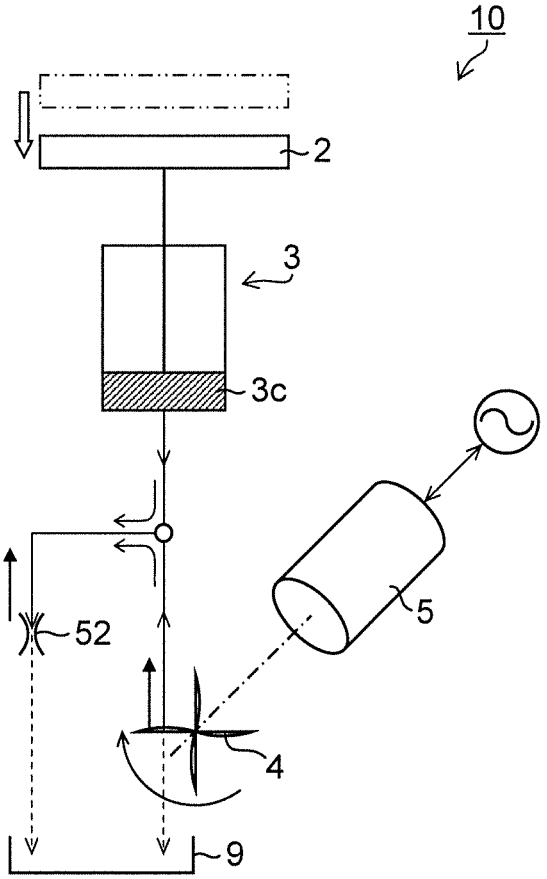
FIG. 2 is another schematic view of the die cushion device of a press machine.
Figure 3:
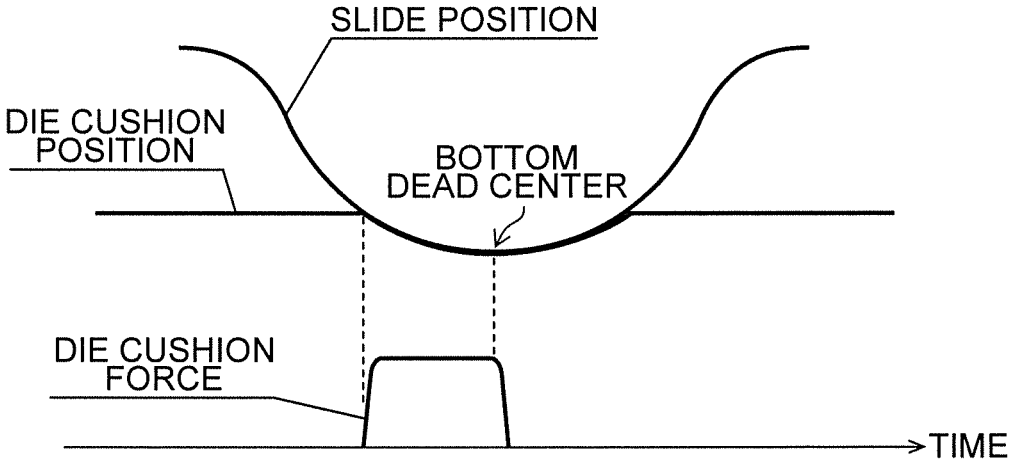
FIG. 3 is a waveform chart illustrating slide position, die cushion position, and die cushion force.

FIGS. 1 and 2 each are a schematic view of a die cushion device of a press machine, according to the present invention, and FIG. 3 is a waveform chart illustrating slide position, die cushion position, and die cushion force.

A die cushion device 10 illustrated in FIG. 1 includes a hydraulic cylinder 3 that supports a cushion pad 2 and generates die cushion force while a slide of the press machine descends, a throttle part (orifice) 52 and a hydraulic pump/motor 4 that are connected to each other in parallel between a cushion-pressure-generating-side pressure chamber (lower chamber) 3*c* of the hydraulic cylinder 3 and a tank 9 serving as a low-pressure source, an electric motor (servo motor) 5 connected to a rotating shaft of the hydraulic pump/motor 4, and a control unit (not illustrated) that controls torque of the servo motor 5 to control the die cushion force.

In the die cushion device 10, the cushion pad 2 is indirectly pressed down by a slide of a press machine, and hydraulic oil is pushed away from the lower chamber 3*c* of the hydraulic cylinder 3 as the cushion pad 2 descends. While hydraulic oil pushed away from the lower chamber 3*c* of the hydraulic cylinder 3 is released to the tank 9 through the hydraulic pump/motor 4 driven by the servo motor 5, a part of the hydraulic oil is released to the tank 9 through an oil passage in a separate system that communicates with the tank 9 through the orifice (fixed hole) 52, and that is provided in parallel with a system in which hydraulic oil is released to the tank 9 through the hydraulic pump/motor 4.

In the present example, torque of the servo motor 5 is controlled such that uniform die cushion force acts during a period from when the slide indirectly collides with the cushion pad 2 staying at a predetermined die cushion position (when die cushion force starts acting) to when die cushion force stops acting (at the press bottom dead center), as illustrated in FIG. 3.

In the first half of a die cushion stroke, where the slide moves at high speed (oil pushed away from the hydraulic cylinder 3 is large in amount), the amount of oil pushed away is released to the tank 9 through the hydraulic pump/motor 4 and the orifice 52, as illustrated in FIG. 1. At this time, a rotation direction of the servo motor 5 controlled in torque (and the hydraulic pump/motor 4) is a first rotation direction (e.g., a forward rotation direction), and the hydraulic pump/motor 4 serves as a hydraulic motor. Then, rotation speed of the servo motor 5 becomes a maximum (in the forward rotation direction) when die cushion force starts acting.

In the latter half of the die cushion stroke, where the slide moves at low speed (oil pushed away from the hydraulic cylinder 3 is small in amount), a total of the amount of oil pushed away and the amount of oil pushed into by the hydraulic pump/motor 4 is released to the tank 9 through the orifice 52, as illustrated in FIG. 2. At this time, a rotation direction of the servo motor 5 controlled in torque (and the hydraulic pump/motor 4) is a second rotation direction (e.g., a reverse rotation direction), and the hydraulic pump/motor 4 serves as a hydraulic pump. Then, rotation speed of the servo motor 5 becomes a maximum (in the reverse rotation direction) when die cushion force stops acting (at the press bottom dead center).

That is, when the orifice 52 (fixed hole) is additionally provided, the servo motor 5 is thoroughly usable at a start and an end of a die cushion force acting process within a range between positive and reverse maximum rotation speeds (rotation speed twice as fast as a maximum rotation speed only in one direction). The orifice 52 may be configured to be usable only in a die cushion force acting process in combination with a solenoid valve, as described below, and a plurality of patterns may be prepared for the orifice depending on die cushion pressure and slide speed. As a result, the orifice can be formed at low cost (the solenoid valve is turned on and off once per cycle), and a system is also simple.

[Technical Verification]

Subsequently, technical verification of rotation speed of the servo motor 5 that is usable within a range between positive and reverse maximum rotation speeds (substantially double the range of rotation speed) will be conducted.

Then, a parameter of each component of the die cushion device 10 is defined as follows. Here, numerical values in parentheses in the following parameters and expressions shows a specific example thereof.

$$Q_{Mot\text{-}max}=1/1000\times N_{Mot\text{-}max}\times q \quad \text{(Expression 1) (120);}$$

$$V1_{max}=1000/60\times Q_{Mot\text{-}max}/S \quad \text{(Expression 2) (31.34);}$$

$$d=(Q_{Mot\text{-}max}/(0.424\times Pr^{1/2}))^{1/2} \quad \text{(Expression 3) (4.27); and}$$

$$Q_{orifice}=0.424\times d^2\times p^{1/2} \quad \text{(Expression 4) (120), where}$$

q [cc/rev] is a pushed away volume of a hydraulic pump/motor driven by a servo motor (40);

$N_{Mot\text{-}max}$ [rpm] is a maximum rotation speed of a servo motor (3000);

S [$cm^2$] is a cross-sectional area of a hydraulic cylinder (63.62);

Pr [$kg/cm^2$] is target die cushion pressure (240.4);

P [$kg/cm^2$] is die cushion pressure (240.4);

$Q_{Mot\text{-}max}$ [1/min] is a maximum amount of oil that can be processed by a hydraulic pump/motor;

$V1_{max}$ [cm/s] is a maximum slide speed that can be conventionally achieved;

d [mm] is an orifice diameter; and $Q_{orifice}$ [1/min] is an amount of oil that can be processed by an orifice.

Expressions 3 and 4 are based on Bernoulli's theorem. Each constant refers to an experimental value. Each constant varies under conditions of hydraulic oil, such as a kind, so that the values given in parentheses above are assumed as specific examples.

$$Q_{Cyl}=Q_{orifice}+Q_{Mot} \quad \text{(Expression 5);}$$

$$V2_{max}=1000/60\times(Q_{orifice}+Q_{Mot\text{-}max})/S \quad \text{(Expression 6) (62.68); and}$$

$$V2_{min}=1000/60\times(Q_{orifice}-Q_{Mot\text{-}min})/S \quad \text{(Expression 7) (0), where}$$

$Q_{Cyl}$ [1/min] is an amount of oil pushed away from a hydraulic cylinder;

$Q_{Mot}$ [1/min] is an amount of oil processed by a hydraulic pump/motor;

$Q_{Mot}$ is from 120 to −120 because it can be controlled from $Q_{Mot\text{-}max}$ to $-Q_{Mot\text{-}max}$;

$Q_{Cyl}$ can be controlled from $Q_{orifice}+Q_{Mot\text{-}max}$ to $Q_{orifice}-Q_{Mot\text{-}max}$ (240 to 0);

$Q_{Cyl\text{-}max}=Q_{orifice}+Q_{Mot\text{-}max}$;

$V2_{max}$ [cm/s] is a maximum slide speed to which the present invention can respond; and $V2_{min}$ [cm/s] is a minimum slide speed to which the present invention can respond, and then, $V2_{max}=1000/60\times2\times Q_{Mot\text{-}max}/S$, resulting in $V2_{max}=2\times V1_{max}$, is acquired from Expressions 3, 4, and 6, so that responding slide speed is doubled as compared with a case without another system including the orifice 52, and the values given in parentheses above are assumed as specific examples.

First Embodiment

Figure 4:
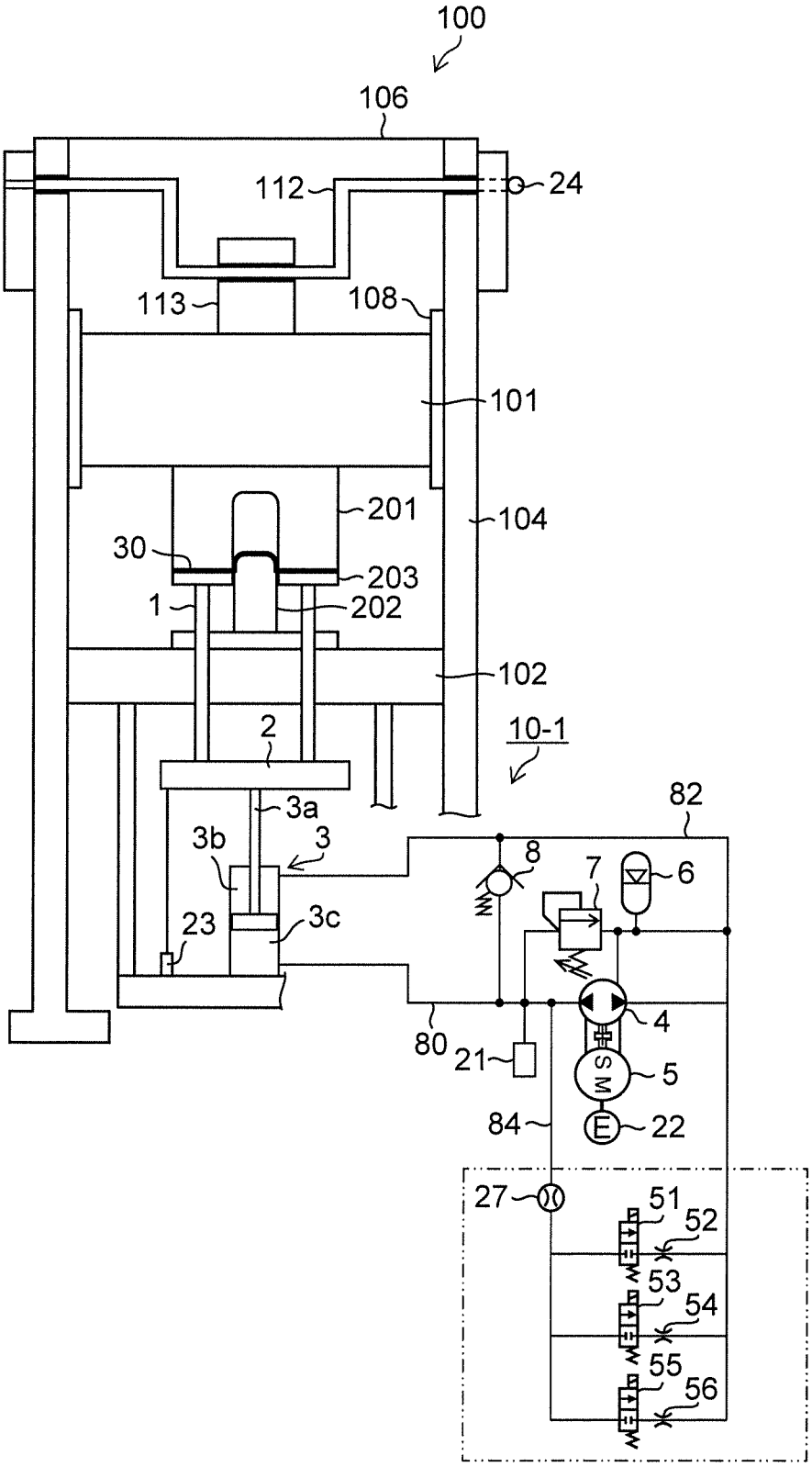
FIG. 4 is a structural view illustrating a die cushion device of a press machine of a first embodiment according to the present invention.

FIG. 4 is a structural view illustrating a die cushion device of a press machine of a first embodiment according to the present invention.

FIG. 4 illustrates a press machine 100 that includes a frame that is composed of a bed 102, a column 104, and a crown 106, and a slide 101 that is movably guided in a vertical direction by a guide section 108 provided in the column 104. The slide 101 is moved in a vertical direction in FIG. 4 by a crank mechanism including a crankshaft 112 to which rotational driving force is transmitted by a driving device (not illustrated), and a connecting rod 113.

The crankshaft 112 includes an encoder 24 to detect an angle and an angular speed of the crankshaft 112.

An upper die 201 is mounted on the slide 101, and a lower die 202 is mounted on (a bolster on) the bed 102.

Between the upper die 201 and the lower die 202, a blank holding plate (blank holder) 203 is disposed such that its bottom face is supported by a cushion pad 2 through a plurality of cushion pins 1 and a material 30 is set (brought into contact with) on its top face.

A die cushion device 10-1 includes a hydraulic cylinder 3 that supports the cushion pad 2, a hydraulic pump/motor 4 and a throttle part surrounded by a two-dot chain line (solenoid valves 51, 53, and 55, and orifices 52, 54, and 56) that are connected to each other in parallel between a cushion-pressure-generating-side pressure chamber (hereinafter referred to as a "lower chamber") 3*c* of the hydraulic cylinder 3 and an accumulator 6 serving as a low-pressure source, an electric (servo) motor 5 connected to a rotating shaft of the hydraulic pump/motor 4, a pressure detector 21 that detects pressure in the lower chamber 3*c* of the hydraulic cylinder 3, and a control unit 300-1 (refer to FIG. 5) that controls the servo motor 5 and the solenoid valves 51, 53, and 55.

The cushion pad 2 is coupled to a piston rod 3*a* of the hydraulic cylinder 3 to be supported by the hydraulic cylinder 3. The cushion pad 2 (or a portion interlocking with a piston of the hydraulic cylinder) is provided with a die cushion position detector 23 that detects a position of the cushion pad 2.

The cushion-pressure-generating-side pressure chamber (hereinafter referred to as a "lower chamber") 3*c* of the hydraulic cylinder 3 is connected to high-pressure-side piping (high-pressure line) 80 to which a pressure detector 21 for detecting pressure in the lower chamber 3*c* is connected and one of discharge ports of the hydraulic pump/motor 4 is also connected.

The hydraulic cylinder 3 includes a descending-side pressure chamber (hereinafter referred to as an "upper chamber") 3*b* that connected to low-pressure-side piping (low-pressure line) 82 to which the other of the discharge ports of the hydraulic pump/motor 4 is connected and the accumulator 6 is also connected.

The lower chamber 3*c* of the hydraulic cylinder 3 is connected to the high-pressure line 80 to which a relief valve (safety valve) 7 is connected, and the accumulator 6 is connected to a low-pressure line (return line) from the relief valve 7. In addition, a check valve 8 is provided in piping connecting the upper chamber 3*b* and the lower chamber 3*c* of the hydraulic cylinder 3 to each other.

Further, in a high-pressure line 84 branching from the high-pressure line 80 connected to the lower chamber 3*c* of the hydraulic cylinder 3, a flow rate detector 27 for detecting a flow rate of pressure oil flowing through high-pressure line 84 and the three solenoid valves 51, 53, and 55 are provided in parallel. The three solenoid valves 51, 53, and 55 are respectively provided with orifices 52, 54 and 56 in series, and the accumulator 6 is connected to an outlet side of each of the orifices 52, 54 and 56. The orifices 52, 54 and 56 of the present example have diameters of 4.3 mm, 1.0 mm, and 2.0 mm, respectively.

The rotating shaft of the hydraulic pump/motor 4 is connected to a drive shaft of the servo motor 5, and the servo motor 5 is provided with an angular speed detector 22 for detecting rotation angular speed of the servo motor 5.

[Principle of Die Cushion Force (Pressure) Control]

Since die cushion force can be expressed by the product of a pressure in the lower chamber 3*c* of the hydraulic cylinder 3 and an area of a cylinder, control of die cushion force means control of the pressure in the lower chamber 3*c* of the hydraulic cylinder 3. The pressure in the lower chamber 3*c* of the hydraulic cylinder 3 is generated by controlling throttle opening of each of the orifices 52, 54 and 56, and torque of the hydraulic pump/motor 4, which are connected to the lower chamber 3*c* of the hydraulic cylinder 3.

A static behavior can be expressed by Expressions 8 and 9 below, and a dynamic behavior can be expressed by Expressions 11 and 12 in addition to Expressions 8 to 10, described below.

$$P=\int K\ \{(v\cdot A-k1Q\cdot\omega-q)/V\}\ dt \quad \text{(Expression 8);}$$

$$t=k2\cdot PQ/(2\pi) \quad \text{(Expression 9);}$$

$$q=k3\cdot d_{or}(P)^{1/2} \quad \text{(Expression 10);}$$

$$PA-F=M\cdot dv/dt+DS\cdot v+fS \quad \text{(Expression 11); and}$$

$$t-T=1\cdot d\omega/dt+DM\cdot\omega+fM \quad \text{(Expression 12), where}$$

A is a cross-sectional area of the lower chamber 3*c* of the hydraulic cylinder 3;

V is a volume of the lower chamber 3*c* of the hydraulic cylinder 3;

P is die cushion pressure;

t is torque of the hydraulic pump/motor 4;

T is torque of the servo motor 5;

I is moment of inertia of the servo motor 5:

DM is a viscous resistance coefficient in the servo motor 5;

fM is friction torque in the servo motor 5;

Q is a pushed away volume of the hydraulic pump/motor 4;

F is force applied to the piston rod 3*a* of the hydraulic cylinder 3 from the slide 101;

v is pad speed of the cushion pad 2, caused by being pressed by the slide 101;

M is inertial mass of the piston rod 3*a* of the hydraulic cylinder 3 and of the cushion pad 2;

DS is a viscous resistance coefficient in the hydraulic cylinder 3;

fS is frictional force in the hydraulic cylinder 3;

ω is angular speed of the servo motor rotated by being pushed by pressure oil;

K is a volume elastic coefficient of hydraulic oil;

k1, k2, and k3 each are a constant of proportionality;

q is the amount of oil passing through each of the orifices 52, 54 and 56; and $d_{or}$ is an orifice diameter (or throttle opening).

Expressions 8 to 11 described above mean that force transmitted to the hydraulic cylinder 3 from the slide 101 through the cushion pad 2 compresses oil in the lower chamber 3*c* of the hydraulic cylinder 3 to generate die cushion pressure. Then, the amount of oil in accordance with die cushion pressure and an orifice diameter is released through each of the orifices 52, 54, and 56. In the first half of a die cushion stroke, where oil pushed away from the hydraulic cylinder 3 is large in amount, die cushion pressure causes the hydraulic pump/motor 4 to serve as a hydraulic motor to rotate the servo motor 5 in a forward direction (regenerative action) when rotating shaft torque generated in the hydraulic pump/motor 4 becomes equal to driving torque of the servo motor 5. Then, die cushion pressure is prevented from increasing so as to be a predetermined die cushion pressure (die cushion pressure command). In addition, in the latter half of the die cushion stroke, where oil pushed away from the hydraulic cylinder 3 is small in amount, the hydraulic pump/motor 4 is caused to serve as a hydraulic pump to rotate the servo motor 5 in a reverse direction when rotating shaft torque generated in the hydraulic pump/motor 4 becomes equal to driving torque of the servo motor 5. Then, die cushion pressure is prevented from decreasing so as to be the predetermined die cushion pressure (die cushion pressure command).

When die cushion force (pressure) is controlled to uniformly act, the amount of oil released through each of the orifices 52, 54, and 56 is to a predetermined amount because the die cushion pressure is uniform. As a result, the die cushion pressure is determined in accordance with driving torque of the servo motor 5. In a die cushion pressure control process, rotation speed of the servo motor continuously varies as the hydraulic pump/motor 4 serves as a hydraulic motor to rotate in a forward rotation direction and serves as a hydraulic pump to rotate in a reverse rotation direction, so that die cushion pressure can be easily stabilized.

Embodiment of Control Unit

Figure 5:
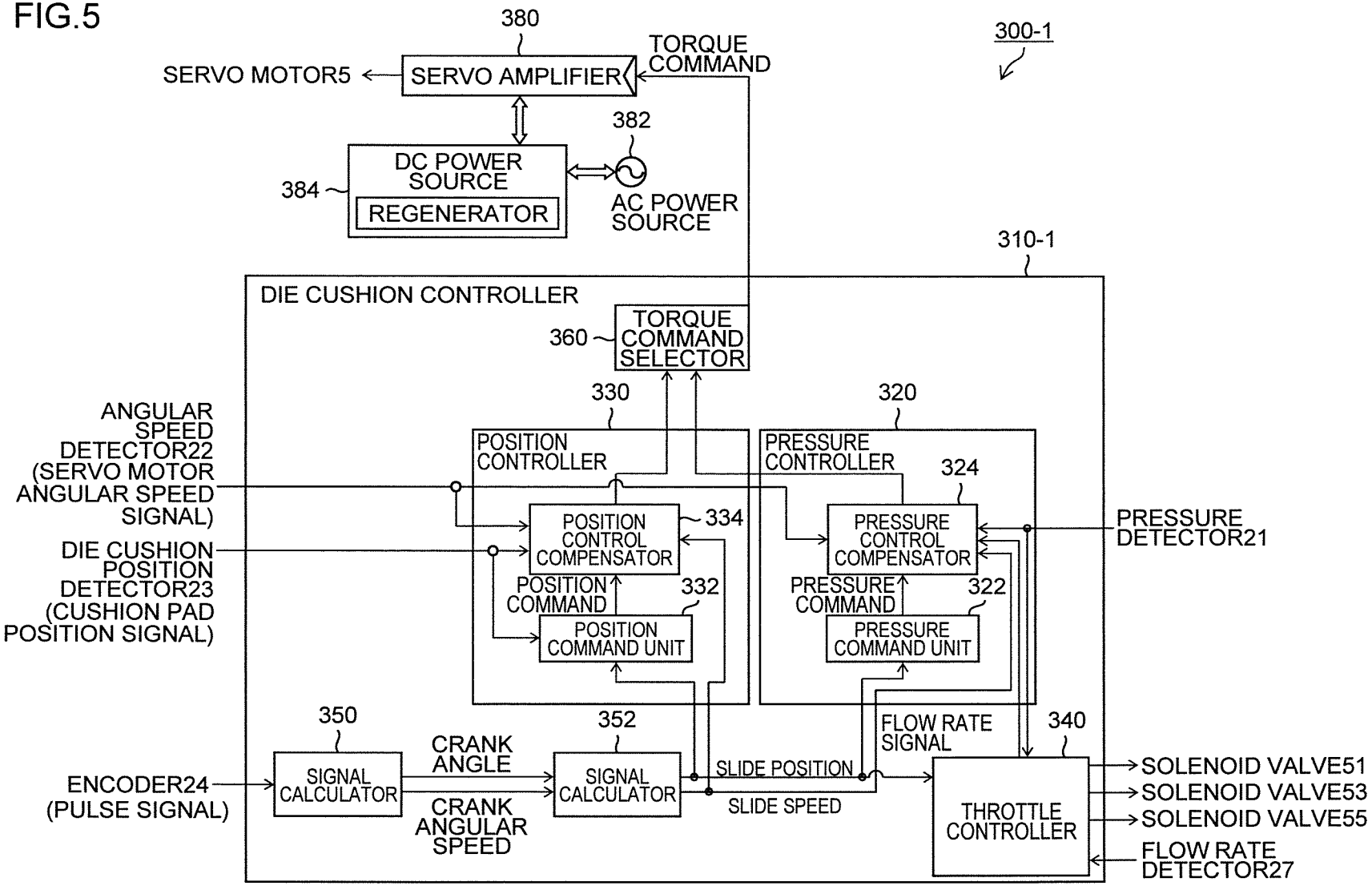
FIG. 5 is a block diagram illustrating an embodiment of a control unit in a die cushion device of the first embodiment illustrated in FIG. 4.

FIG. 5 is a block diagram illustrating an embodiment of the control unit 300-1 in the die cushion device 10-1 of the first embodiment illustrated in FIG. 4.

The control unit 300-1 illustrated in FIG. 5 includes a die cushion controller 310-1, a servo amplifier 380 including a pulse width modulation (PWM) controller, an AC power source 382, and a DC power source 384 with electric power regenerative function.

The die cushion controller 310-1 includes a pressure controller 320 provided with a die cushion pressure command unit 322 and with a pressure control compensator 324, a position controller 330 provided with a die cushion position command unit 332 and with a position control compensator 334, a throttle controller 340, signal calculators 350 and 352, and a torque command selector 360.

The signal calculator 350 receives an encoder signal (pulse signal) from the encoder 24 provided in the crankshaft 112. Then, the signal calculator 350 creates a crankshaft angle signal and a crank angular speed signal from the encoder signal received, and outputs the signals to the signal calculator 352. The signal calculator 352 converts the crankshaft angle signal and the crank angular speed signal received from the signal calculator 350 into a slide position signal and a slide speed signal, respectively. Then, the signal calculator 352 outputs the slide position signal converted to the pressure controller 320, the position controller 330, and the throttle controller 340, and outputs the slide speed signal converted to the pressure controller 320 and the position controller 330.

While the encoder 24, and the signal calculators 350 and 352, serve as a slide position detector and a slide speed detector, respectively, in the present example, besides this, a slide position detector and a slide speed detector for respectively detecting position and speed of the slide 101 may be provided between the slide 101 and the bed 102 of the press machine 100.

The pressure controller 320 receives a die cushion pressure signal indicating die cushion pressure, a servo motor angular speed signal indicating angular speed of the servo motor 5, and a flow rate signal indicating a flow rate of hydraulic oil (a flow rate of hydraulic oil passing through the high-pressure line 84 (the orifices 52, 54, and 56) branching from the high-pressure line 80), which are respectively detected by the pressure detector 21, the angular speed detector 22, and the flow rate detector 27, illustrated in FIG. 4.

The die cushion pressure command unit 322 outputs a die cushion pressure command signal to the pressure control compensator 324 on the basis of the slide position signal received. In the case of the present example, the die cushion pressure command unit 322 outputs a stepwise die cushion pressure command signal, for example, and controls output timing and the like of a die cushion pressure command signal on the basis of the slide position signal.

In a die cushion pressure control state, the pressure control compensator 324 creates a torque command signal to drive the servo motor 5, on the basis of a die cushion pressure command signal, a die cushion pressure signal, a slide speed signal, a flow rate signal, and a servo motor angular speed signal, which are output from the die cushion pressure command unit 322. That is, the pressure control compensator 324 creates a torque command signal by using a die cushion pressure signal as a pressure feedback signal to control die cushion pressure as indicated by the die cushion pressure command signal received from the die cushion pressure command unit 322. The pressure control compensator 324 uses a servo motor angular speed signal as a feedback or feedforward signal to secure dynamic stability of die cushion pressure, and uses a slide speed signal and a flow rate signal as a feedback or feedforward signal to improve control accuracy of die cushion pressure.

When control is switched from a die cushion position control state (die cushion standby position (holding) control state) to a die cushion pressure control state, the pressure controller 320 creates a torque command signal on the basis of a die cushion pressure command signal, a die cushion pressure signal, a slide speed signal, a flow rate signal, and a servo motor angular speed signal, and outputs the torque command signal to the torque command selector 360.

The position controller 330 receives a slide position signal and a slide speed signal from the signal calculator 352, and also receives a die cushion position signal indicating a position of the cushion pad 2 detected by the die cushion position detector 23 illustrated in FIG. 4, and a servo motor angular speed signal indicating angular speed of the servo motor 5 detected by the angular speed detector 22.

The die cushion position command unit 332 receives a slide position signal to grasp a starting point of creating a die cushion position command, as well as to prevent interference with a slide, and a die cushion position signal to create an initial value of a die cushion position command. The die cushion position command unit 332 then creates and outputs a die cushion position command signal to control a die cushion position (a position of the cushion pad 2) to cause product knock-out operation to be performed after the slide 101 reaches the bottom dead center to allow die cushion force to stop acting, as well as to cause the cushion pad 2 to stay at a die cushion standby position being an initial position.

In a die cushion position control state, the position control compensator 334 creates a torque command signal on the basis of a die cushion position command signal, a die cushion position signal, a servo motor angular speed signal, and a slide speed signal, which are output from the die cushion position command unit 332. That is, the position control compensator 334 creates a torque command signal by using a die cushion position signal as a position feedback signal to control die cushion position as indicated by the die cushion position command signal received from the die cushion position command unit 332. The position control compensator 334 uses a servo motor angular speed signal as a feedback or feedforward signal to secure dynamic stability of position of the cushion pad 2, and uses a slide speed signal as a feedback or feedforward signal to improve positional response of the cushion pad 2.

The torque command selector 360 receives a torque command signal created by the pressure controller 320, or a torque command signal created by the position controller 330. The torque command selector 360 then determines whether the slide 101 is in a die cushion force control process, and mainly in a region of a forming process, or is in a die cushion position control process, and mainly in a region of a non-forming process, on the basis of a slide position signal and a die cushion position signal. When the slide 101 is in the region of the forming process, the torque command selector 360*a* selectively outputs a torque command signal created by the pressure controller 320, and when the slide 101 is in the region of the non-forming process, the torque command selector 360*a* selectively outputs a torque command signal created by the position controller 330.

The throttle controller 340 receives a slide position signal from the signal calculator 352, and the throttle controller 340 then outputs a command signal to open and close (turning on and off) each of the solenoid valves 51, 53, and 55, on the basis of the slide position signal. The throttle controller 340 of the present example outputs a command signal to turn on or off the corresponding solenoid valves 51, 53, and 55 such that throttle opening with combination of the orifices 52, 54 and 56 becomes uniform during generation of die cushion force. During a period other than during generation of die cushion force, the throttle controller 340 outputs a command signal to turn off all of the solenoid valves 51, 53, and 55 to enable position control of the cushion pad 2.

The die cushion controller 310-1 causes the torque command selector 360 to output a torque command to control torque of the servo motor 5 to the servo motor 5 through the servo amplifier 380, and causes the throttle controller 340 to output a command signal to turn on and off the each of the solenoid valves 51, 53, and 55.

After the time of a collision of the slide 101 (when the slide 101 is directly or indirectly brought into contact with the cushion pad 2), power of the slide 101 causes pressure to be generated in the hydraulic cylinder 3 through the die/blank holding plate 203, the cushion pin 1, and the cushion pad 2, and then hydraulic oil is pushed away from the hydraulic cylinder 3.

In the first half of a die cushion stroke, where the slide moves at high speed (oil pushed away from the hydraulic cylinder 3 is large in amount), a part of the amount of oil pushed away from the hydraulic cylinder 3 is released to a low-pressure source side through the corresponding solenoid valves 51, 53, and 55 that are tuned on and the orifices 52, 54 and 56 connected in series to the corresponding solenoid valves. The released oil causes the hydraulic pump/motor 4 to serve as a hydraulic motor, and pushes away the hydraulic pump/motor 4 to rotate it.

At this time, a rotation direction of the servo motor 5 (and the hydraulic pump/motor 4) controlled in torque is a forward rotation direction, and the servo motor 5 is rotated (regenerative action) when rotating shaft torque generated in the hydraulic pump/motor 4 becomes equal to driving torque of the servo motor 5. That is, electric power generated by the servo motors 5 is regenerated in the AC power source 382 through the servo amplifier 380, and the DC power source 384 with a function of regenerating electric power.

In addition, in the latter half (a lower half region or less in one stroke of the cushion pad) of the die cushion stroke, where the slide moves at low speed (oil pushed away from the hydraulic cylinder 3 is small in amount), a rotation direction of the servo motor 5 (and the hydraulic pump/motor 4) controlled in torque is switched to a reverse rotation direction, and the servo motor 5 is rotated in the reverse direction when rotating shaft torque generated in the hydraulic pump/motor 4 becomes equal to driving torque of the servo motor 5. The total of the amount of oil pushed into discharged from the hydraulic pump/motor 4 serving as a hydraulic pump and the amount of oil pushed away from the hydraulic cylinder 3 is released to the low-pressure source side through the corresponding solenoid valves 51, 53, and 55 that are tuned on and the orifices 52, 54 and 56 connected in series to the corresponding solenoid valves.

Meanwhile, once the slide 101 reaches the bottom dead center (press forming finishes), the die cushion controller 310-1 is switched from a die cushion pressure control state to a die cushion position (holding) control state.

In the die cushion position control state, a torque command signal output from the position controller 330 is output to the servo motor 5 through the torque command selector 360 and the servo amplifier 380, and then the servo motor 5 is controlled in torque.

At this time, the position controller 330 stops a die cushion device for a predetermined time after the slide 101 starts rising to prevent an accident in which the slide 101, a formed product, and die cushion device interfere with each other to break the formed product. Then, the position controller 330 causes the hydraulic cylinder 3 (cushion pad 2) to rise to knock out the formed product in close contact with the lower die 202, and causes the hydraulic cylinder 3 to return to an initial position (standby position) for the next cycle. In the die cushion position (holding) control state, all of the solenoid valves 51, 53, and 55 are turned off to release pressure oil through the orifices 52, 54 and 56, respectively.

COMPARATIVE EXAMPLE

In comparison between the die cushion device 10-1 of the first embodiment of the present invention and the conventional die cushion device described in Patent Literature 1 (hereinafter referred to as simply a "conventional die cushion device"), a difference in operation effect of both the die cushion devices will be described.

The conventional die cushion device is mainly different from the die cushion device 10-1 of the first embodiment illustrated in FIG. 4 in structure without the throttle parts (the solenoid valve 51, 53, and 55, and the orifices 52, 54 and 56) surrounded by a two-dot chain line illustrated in FIG. 4.

<Action of Conventional Die Cushion Device>

Action of the conventional die cushion device will be described with reference to FIGS. 6 to 9.

Figure 6:
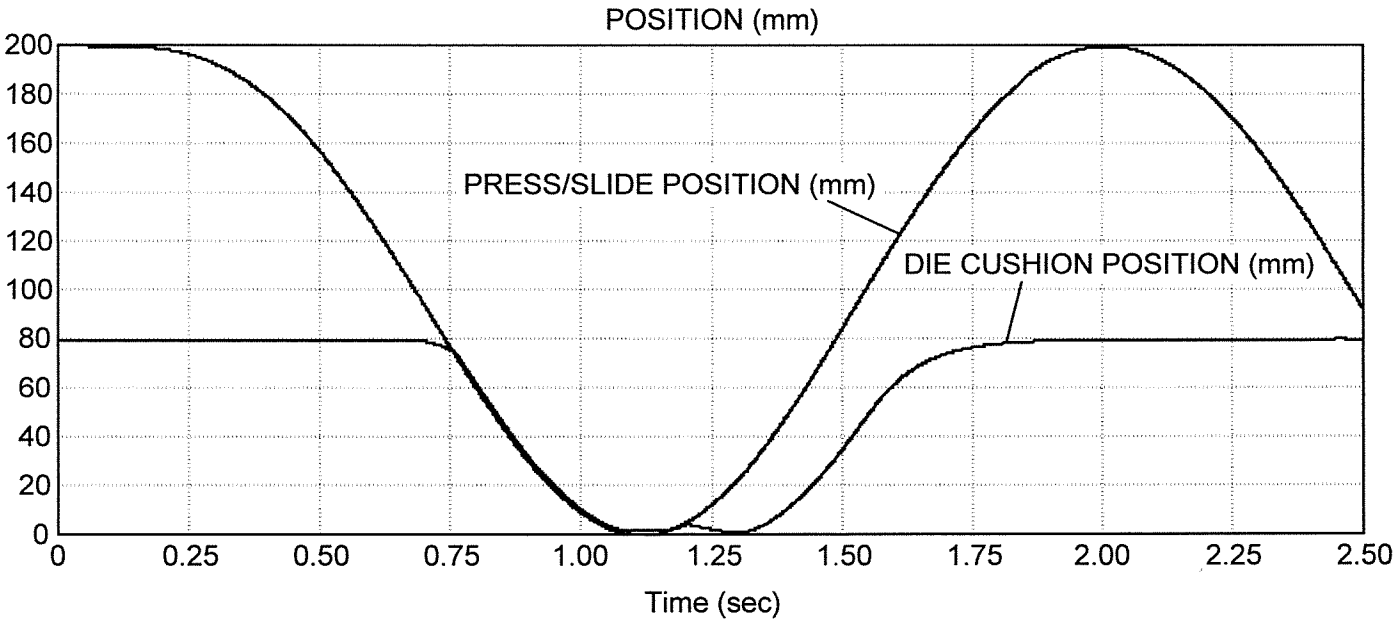
RELATED ART FIG.6
FIG. 6 is a waveform chart illustrating slide position and die cushion position in a conventional die cushion device.
Figure 7:
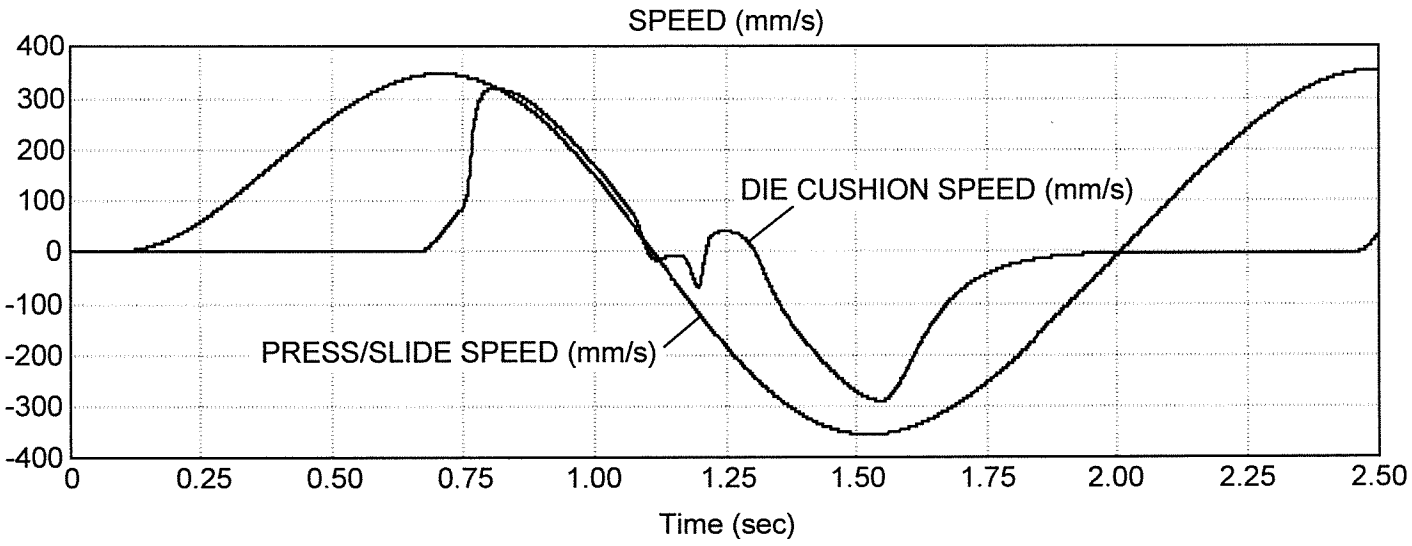
RELATED ART FIG.7
FIG. 7 is a waveform chart illustrating slide speed and die cushion speed in the conventional die cushion device.
Figure 8:
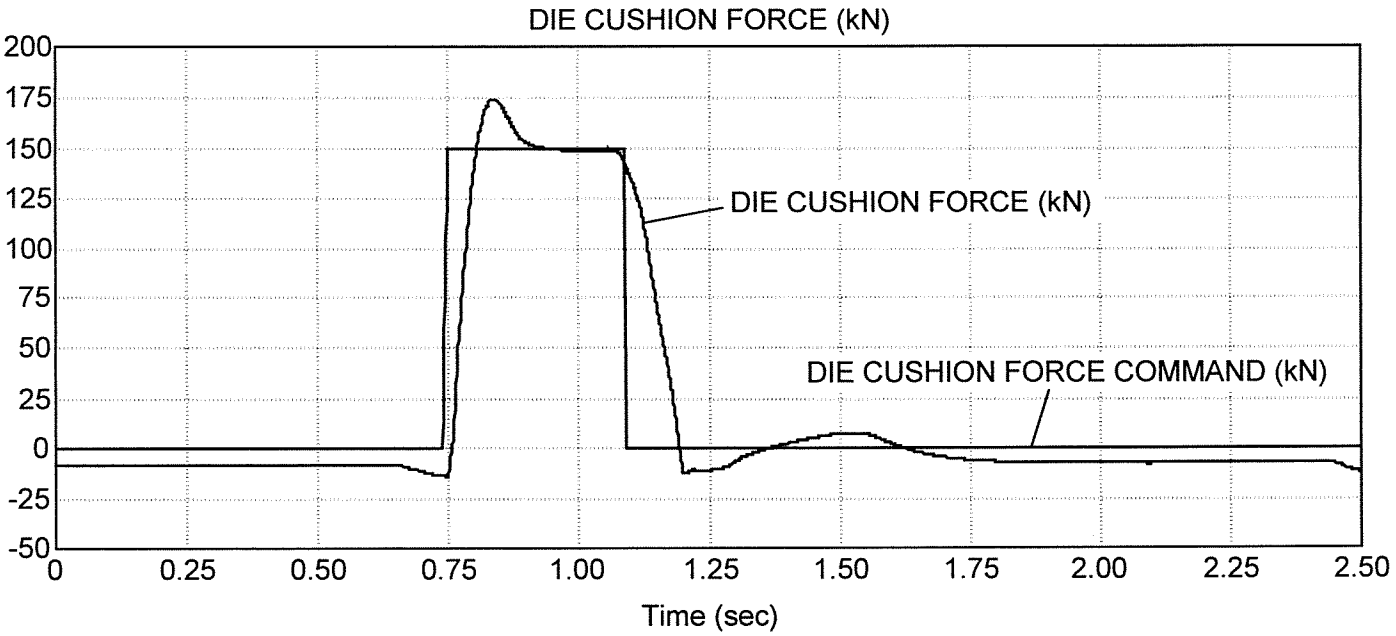
RELATED ART FIG.8
FIG. 8 is a waveform chart illustrating die cushion force command and die cushion force in the conventional die cushion device.
Figure 9:
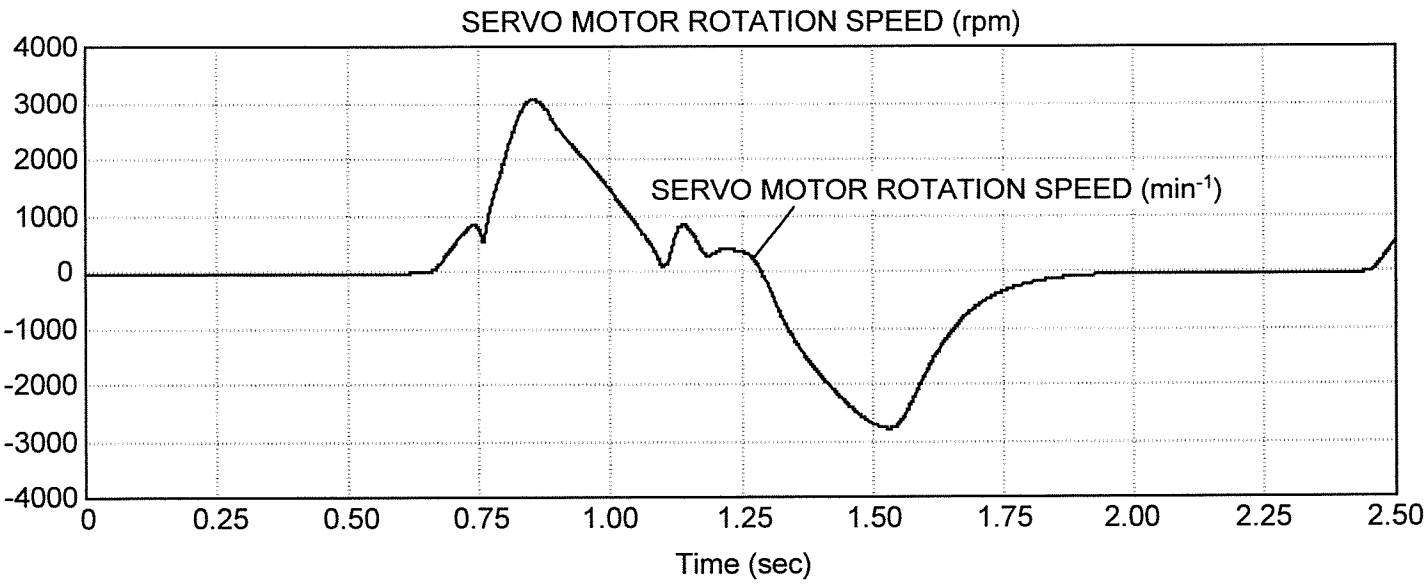
FIG. 9 is a waveform chart illustrating rotation speed of a servo motor in the conventional die cushion device.

FIGS. 6 to 9 each are a waveform chart illustrating change in each physical amount in the conventional die cushion device. FIG. 6 is a waveform chart illustrating slide position and die cushion position, FIG. 7 is a waveform chart illustrating slide speed and die cushion speed, FIG. 8 is a waveform chart illustrating die cushion force command and die cushion force, and FIG. 9 is a waveform chart illustrating rotation speed of a servo motor.

A press machine is a crank type, and a stroke of a slide is set to 200 mm, a stroke (die cushion stroke) of a cushion pad is set to 80 mm (refer to FIG. 6). In addition, a die cushion force command is set to 150 kN (refer to FIG. 8), the press machine is driven at a slide stroke number of 30 spm (refer to FIG. 6), while the cushion pad is interlocked.

When a slide descends from the top dead center while a cushion pad stays at a standby position of 80 mm, the slide collides with the cushion pad that is preliminarily accelerated downward from when the slide reaches a position about 90 mm above the bottom dead center to relieve shock, or to reduce relative speed to the slide at the time of a collision (refer to FIGS. 6 and 7). When the slide collides with the cushion pad at a position about 75 mm above the bottom dead center after the cushion pad is preliminarily accelerated, die cushion force control starts (refer to FIG. 6). Even if the slide and the cushion pad are controlled as described above, a surge in die cushion force (overshoot) may be caused due to response delay when a servo motor and its rotating shaft interlocking with the servo motor are rapidly angularly accelerated (refer to FIG. 8).

Die cushion speed (speed of a cushion pad, or speed of a hydraulic cylinder) always follows slide speed (refer to FIG. 7) during a die cushion force control process (a section from a position 80 mm above the bottom dead center to the bottom dead center (0 mm)). That is, die cushion speed depends on slide speed, and rotation speed of a servo motor (refer to FIG. 9) is in proportion to die cushion speed.

The die cushion speed becomes a maximum at the time when the die cushion force control starts, and rotation speed of the servo motor indicates about 3000 $min^{-1}$ of an allowable limit value of in the present example. Meanwhile, rotation speed of the servo motor indicates zero at the time when the die cushion force control finishes (press bottom dead center). In this die cushion stroke, a slide stroke number depends on rotation speed at the time of start, and thus is unable to exceed this number (30 spm).

Action of Die Cushion Device of First Embodiment

With reference to FIGS. 10 to 15, action of the die cushion device 10-1 of the first embodiment of the present invention illustrated in FIG. 4 will be described.

Figure 10:
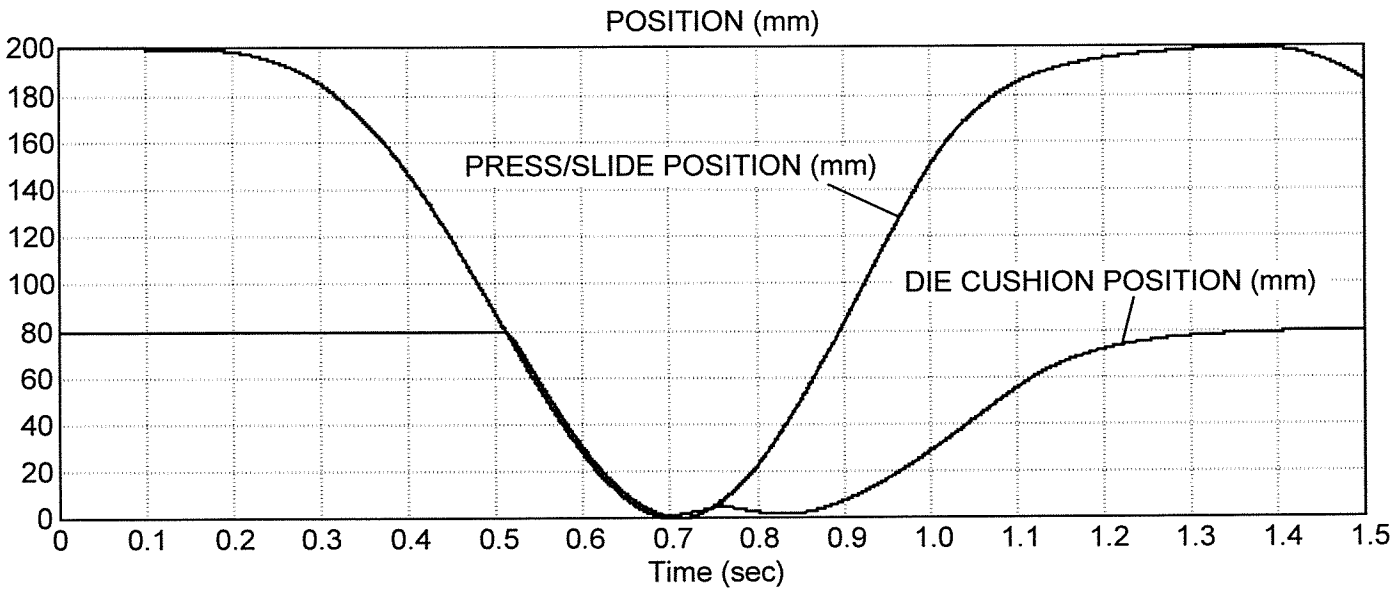
FIG. 10 is a waveform chart illustrating slide position and die cushion position in the die cushion device of the first embodiment of the present invention.
Figure 11:
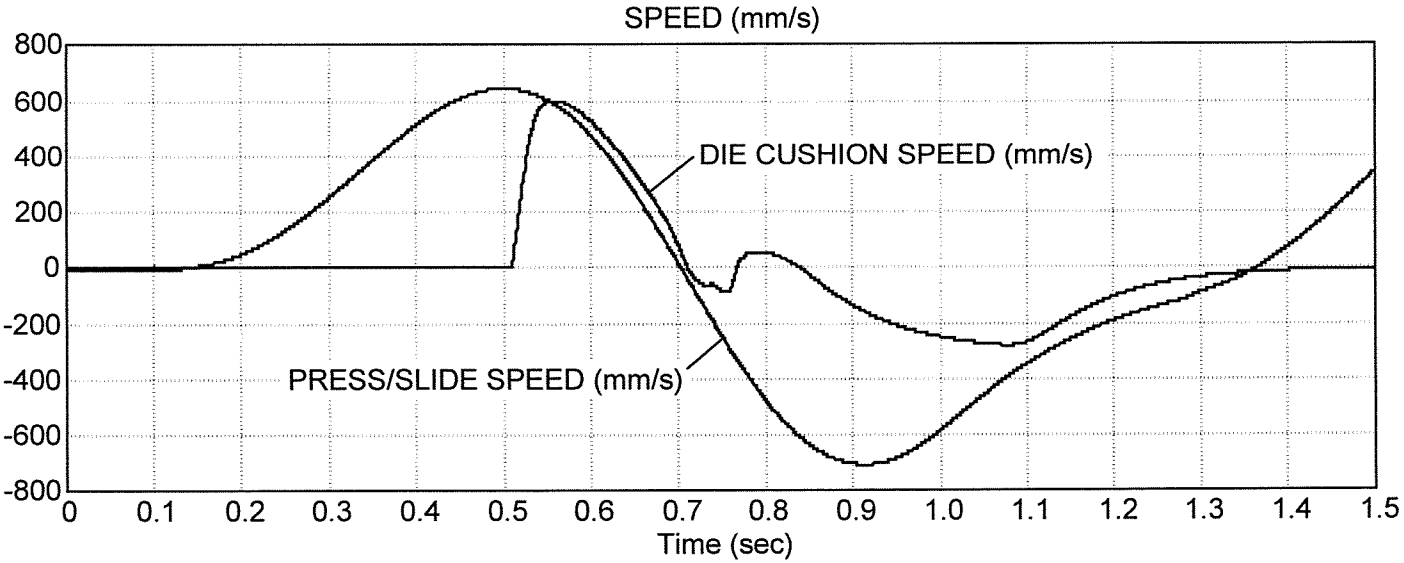
FIG. 11 is a waveform chart illustrating slide speed and die cushion speed in the die cushion device of the first embodiment of the present invention.
Figure 12:
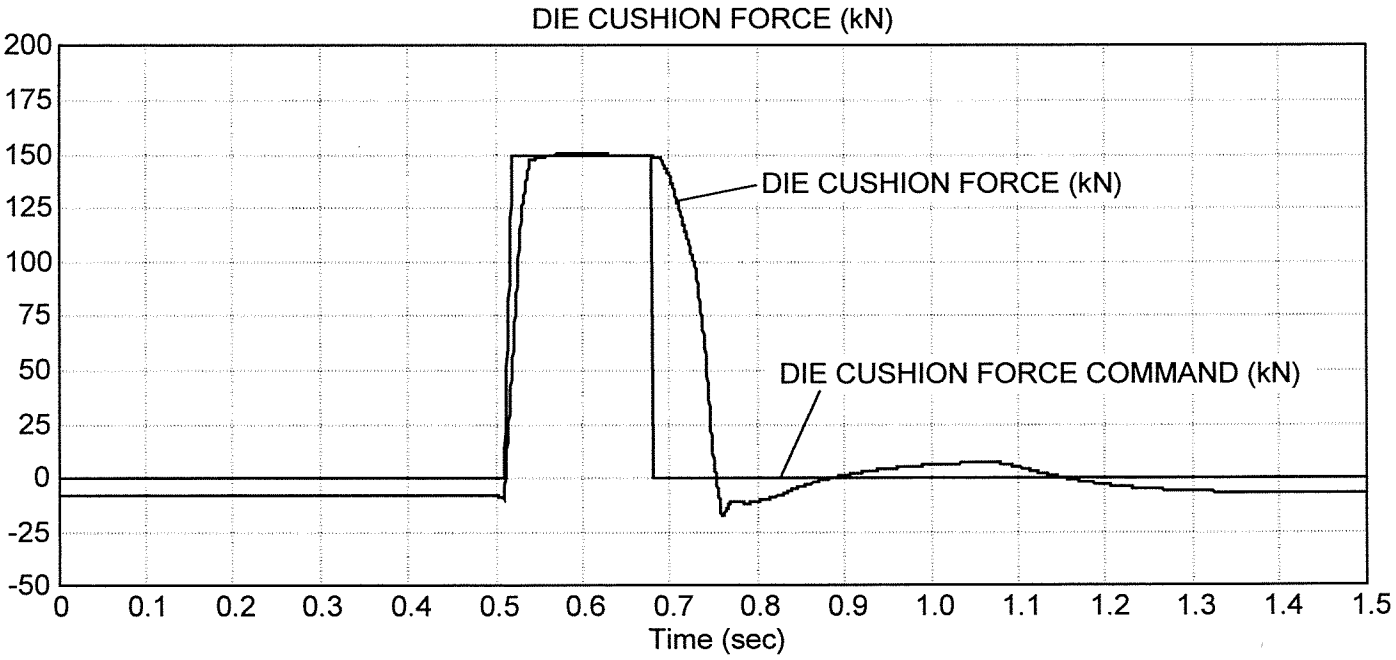
FIG. 12 is a waveform chart illustrating die cushion force command and die cushion force in the die cushion device of the first embodiment of the present invention.
Figure 13:
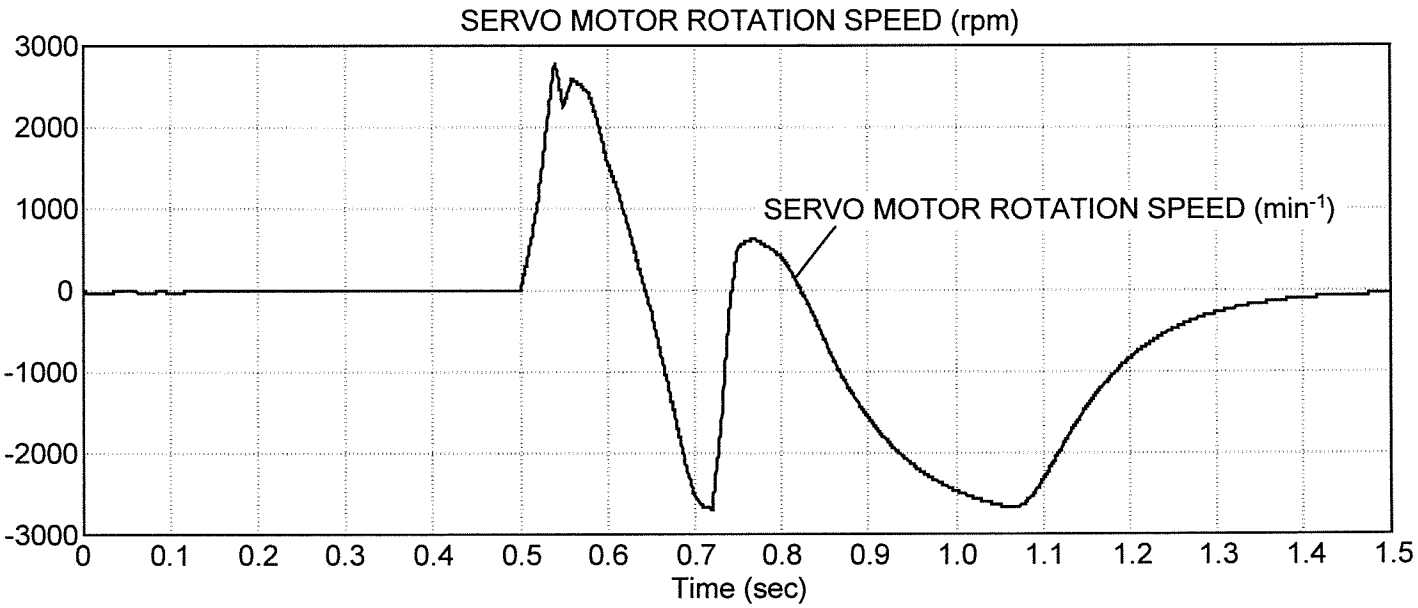
FIG. 13 is a waveform chart illustrating rotation speed of a servo motor in the die cushion device of the first embodiment of the present invention.
Figure 14:
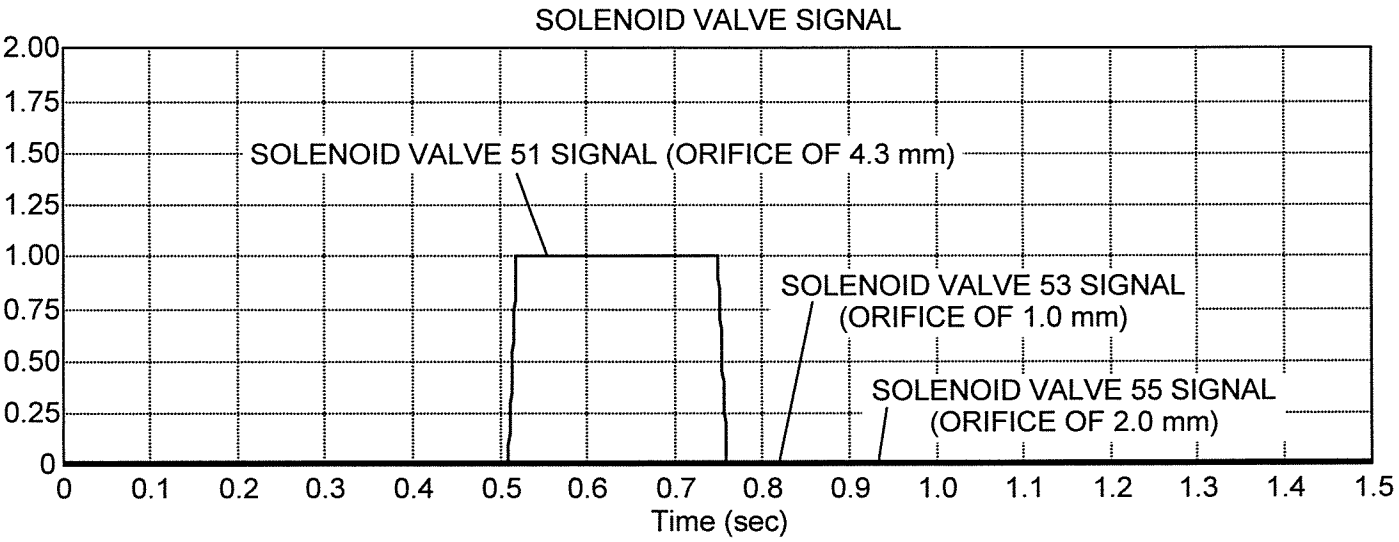
FIG. 14 is a waveform chart illustrating command signals for turning on and off a solenoid valve in the die cushion device of the first embodiment of the present invention.
Figure 15:
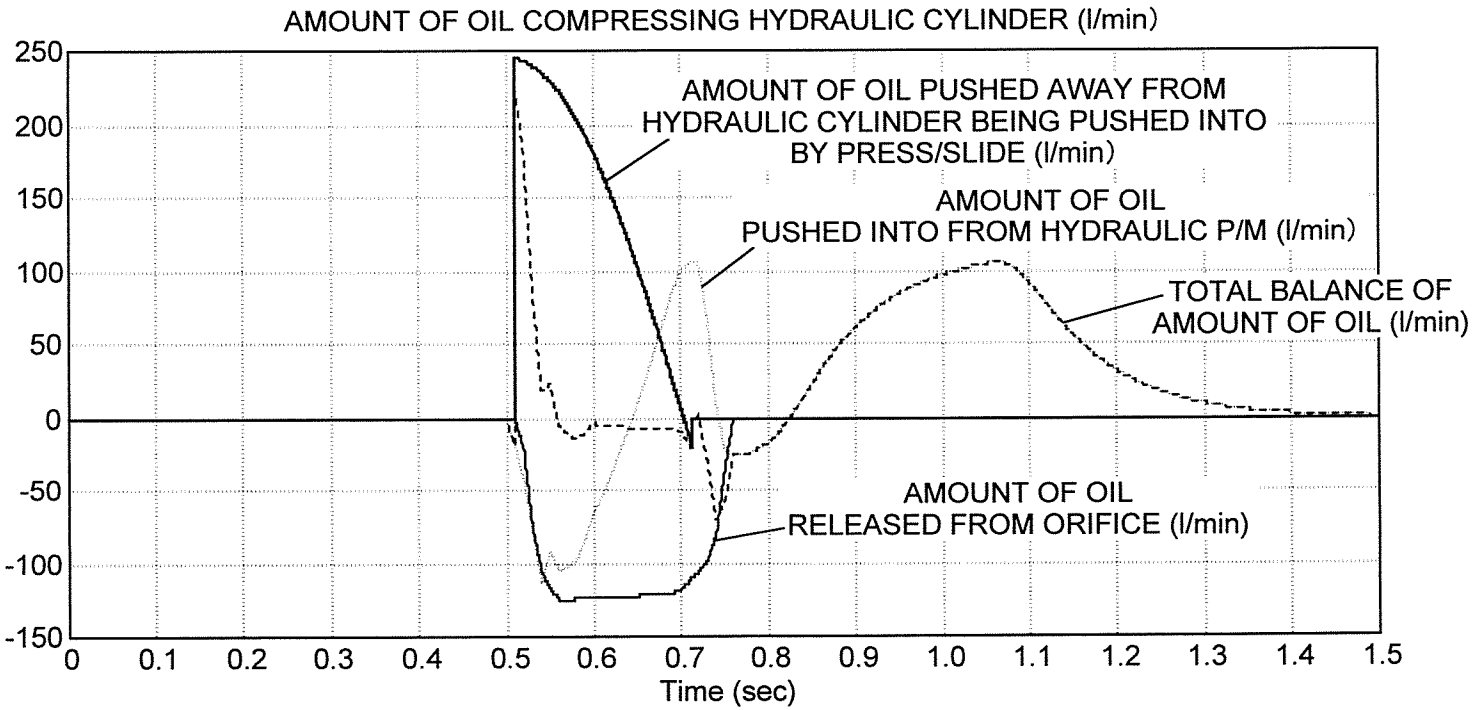
FIG. 15 is a waveform chart illustrating the amount of oil that flows into and out from a hydraulic cylinder, a hydraulic pump/motor, and an orifice in the die cushion device of the first embodiment of the present invention.

FIGS. 10 to 15 each are a waveform chart illustrating change in each physical amount in the die cushion device 10-1 of the first embodiment of the present invention. FIG. 10 is a waveform chart illustrating slide position and die cushion position, FIG. 11 is a waveform chart illustrating slide speed and die cushion speed, FIG. 12 is a waveform chart illustrating die cushion force command and die cushion force, FIG. 13 is a waveform chart illustrating rotation speed of a servo motor, FIG. 14 is a waveform chart illustrating command signals (0 and 1) for turning on and off solenoid valves 51, 53, and 55, and FIG. 15 is a waveform chart illustrating the amount of oil that flows into and out from the hydraulic cylinder 3, the hydraulic pump/motor 4, and the orifice 52.

As illustrated in FIG. 4, the press machine 100 is a crank type, and a stroke of the slide 101 is set to 200 mm, a stroke (die cushion stroke) of the cushion pad 2 is set to 80 mm (refer to FIG. 10). In addition, a die cushion force command is set to 150 kN (refer to FIG. 12), the press machine 100 is driven (refer to FIG. 11) at a slide stroke number of 60 spm (twice the conventional example), while the cushion pad 2 is interlocked.

When the slide 101 descends from the top dead center while the cushion pad 2 stays at a standby position of 80 mm, the slide 101 collides with the cushion pad 2 when reaching the standby position of 80 mm (FIG. 10). At this time, the cushion pad 2 is not preliminarily accelerated downward just before the collision.

Die cushion force control starts from the time of collision (refer to FIG. 12). At almost the same time (at the same time in the present example), a command signal to turn on only the solenoid valve 51 is output (refer to FIG. 14). In the present example, the solenoid valves 53 and 55 are still turned off also during a die cushion force control period, so that the orifice 52 (with a hole diameter of 4.3 mm) connected in series to the solenoid valve 51 contributes to rising of die cushion pressure.

As described above, even if the slide 101 (through an upper die, a material, a blank holding plate, a cushion pin, and the like) collides with a die cushion (cushion pad 2) at rest, die cushion pressure stabilizes without causing a surge (overshoot) by action of the amount of oil released through the orifice 52 with a hole diameter of 4.3 mm when the solenoid valve 51 is turned on. This compensates for delay in release of hydraulic oil due to response delay when a servo motor and its rotating shaft interlocking with the servo motor are rapidly angularly accelerated. As a result, preliminary acceleration to prevent a surge is made unnecessary, so that die cushion pressure acts earlier by a time acquired by eliminating the preliminary acceleration (refer to FIG. 12).

As with action of the conventional die cushion device, die cushion speed (speed of a cushion pad, or speed of a hydraulic cylinder) always follows slide speed (refer to FIG.

11) during a die cushion force control process (a section from a position 80 mm above the bottom dead center to the bottom dead center (0 mm)).

The die cushion speed is not in proportion to rotation speed of the servo motor (refer to FIG. 13), and is in proportion to a total of the amount of oil (a positive or negative amount of oil pushed into by the hydraulic pump/motor) corresponding to the rotation speed of the servo motor, and the amount of oil released through an orifice. The die cushion speed becomes a maximum at the time when the die cushion force control starts, and rotation speed of the servo motor at the time indicates about 3000 $min^{-1}$ close to an allowable limit value (refer to FIG. 13) in the present example. Then, a total of about −120 l/min of the amount of oil released by the hydraulic pump/motor (the negative amount of oil pushed into by the hydraulic pump/motor illustrated in FIG. 15) in proportion to the rotation speed, and about −120 l/min of the amount of oil released through the orifice (refer to FIG. 15), is in proportion to die cushion speed, and becomes equal to −240 l/min of the amount of oil pushed away from the hydraulic cylinder (refer to FIG. 15). Meanwhile, the die cushion speed becomes minimum at the time when the die cushion force control finishes near the press bottom dead center, and rotation speed of the servo motor at the time indicates about −3000 $min^{-1}$ (refer to FIG. 13) close to an allowable limit value in reverse rotation in the present example.

As a result, the die cushion device 10-1 of the first embodiment is capable of responding a slide stroke number (60 spm) twice the maximum slide stroke number (30 spm) of the conventional die cushion device.

The die cushion force control process will be described in more details.

In the present example, a die cushion pressure of 240.4 $kg/cm^2$ in proportion to a die cushion force of 150 kN is controlled throughout a die cushion stroke (refer to FIG. 12). At the time when the slide 101 indirectly collides with a die cushion (cushion pad 2) to start die cushion force control, about 240 l/min of the amount of oil pushed away from a hydraulic cylinder, corresponding to about 600 mm/s of slide speed is compensated by −120 l/min of the amount of oil released to the low-pressure line 82 from the hydraulic pump/motor 4 with rotation of the servo motor, and by about −120 l/min of the amount of oil released through the orifice 52 with a hole diameter of 4.3 mm when the solenoid valve 51 is turned on (opened) to communicate with the orifice 52 (total balance of the amount of oil becomes almost zero).

The solenoid valve 51 is commanded to be turned on near (before or after) when die cushion force control starts, and to be turned off near (before or after) when die cushion force control finishes. Turning-on timing and turning-off timing are determined depending on responsivity of a solenoid valve used. In the present example, a command is just activated at the time when the die cushion force control starts (refer to FIG. 14), and a spool of the solenoid valve 51 starts to open in about 0.01 s after the command is activated, and fully opens in about 0.06 s. The orifice 52 connected in series to the solenoid valve 51 accordingly starts serving in 0.01 s, and serves corresponding to a diameter of 4.3 mm in about 0.05 s.

The amount of oil released through the orifice 52 is determined in proportion to a square root of die cushion pressure according to Bernoulli's theorem as illustrated in Expression 4, and becomes about 120 l/min at the time when die cushion pressure reaches about 240 $kg/cm^2$ of a predetermined die cushion pressure immediately after the die cushion force control starts. The amount of oil released, together with about 120 l/min of the amount of oil released at a maximum rotation (3000 $min^{-1}$) of the servo motor that is compensated by only the hydraulic pump/motor of the conventional die cushion device, compensate for 240 l/min of the amount of oil pushed away from the hydraulic cylinder, so that it is possible to respond to slide speed twice that of the conventional die cushion device.

Then, as die cushion pressure is about to exceed (overshoot) a predetermined value of 240 $kg/cm^2$, the amount of oil released through the orifice 52 also increases according to Bernoulli's theorem, and a total of the amount of oil released through the orifice 52 and the amount of oil released from the hydraulic pump/motor 4 is about to exceed the amount of oil pushed away from the hydraulic cylinder to prevent further volume compression (pressurization) action of the hydraulic cylinder. As a result, (counter) action to reduce die cushion pressure works. The action greatly contributes to prevention of a surge (overshoot) in die cushion pressure. This eliminates the need for preliminary downward acceleration of a cushion pad that is conventionally needed to prevent an overshoot, so that die cushion force control starts earlier to allow die cushion force to start acting earlier as compared with the conventional die cushion device.

As the slide 101 descends to allow die cushion stroke to proceed, slide speed decreases to reduce the amount of oil pushed away from the hydraulic cylinder. To maintain 240 $kg/cm^2$ of the predetermined pressure, 120l/min of the amount of oil released through the orifice 52 needs to be maintained. Thus, the hydraulic pump/motor 4 driven by the servo motor 5 pushes into the amount of oil corresponding to a difference between the amount of oil pushed away from the hydraulic cylinder and the amount of oil released through the orifice 52 such that total balance of the amount of oil becomes zero. At the time, the amount of oil pushed away from the hydraulic cylinder can be estimated by calculation using slide speed, and the amount of oil released through the orifice 52 can be detected by the flow rate detector 27. In the present example, the amount of oil released through the orifice 52 (flow rate signal) is used in compensation under die cushion pressure control to calculate a torque command for the servo motor 5. This enables smoother control of die cushion pressure.

When the flow rate detector is not provided in the present example, the amount of oil released through an orifice (flow rate signal) is calculated by some sort of means, such as an estimation by calculation using pressure detected by the pressure detector 21, a turning-on/off command signal for a solenoid valve and responsivity to the signal, and an orifice diameter.

As a result, the amount of oil released by the hydraulic pump/motor 4 determined as a difference between the amount of oil pushed away from the hydraulic cylinder and the amount of oil released through the orifice 52 gradually decreases from the time when die cushion force control starts, and becomes zero when slide speed decreases to a half (about 300 mm/s) of that at the time when die cushion force control starts (about 600 mm/s), or at the time near 0.65 s in FIG. 15. That is, rotation speed of the servo motor 5 becomes zero (at the time near 0.65 s in FIG. 13). In this instant, the amount of oil pushed away from the hydraulic cylinder is equal to the amount of oil released through the orifice 52.

After that (slide speed becomes 300 mm/s or less), the servo motor 5 rotates in the reverse direction to discharge (push into) pressure oil through one of discharge ports (a discharge port connected to the high-pressure line 80) of the hydraulic pump/motor 4, so that about 120 l/min of the amount of oil released through the orifice 52 is maintained to maintain about 240 kg/cm$^2$ of die cushion pressure.

As the slide 101 approaches the bottom dead center and slide speed approaches zero, the amount of oil pushed into by the hydraulic pump/motor 4 increases to maintain about 120 l/min of the amount of oil released through the orifice 52, and then rotation speed of the servo motor 5 increases in proportion to the amount of oil pushed into. The slide speed then becomes zero at the bottom dead center, and the amount of oil pushed into by the hydraulic pump/motor 4 reaches 120 l/min corresponding to about −3000 min$^{-1}$ of the maximum rotation speed of the servo motor 5 in the reverse rotation direction.

As described above, in a servo die cushion device in which a servo motor is driven to transmit power using hydraulic medium, the servo motor 5 continuously serves from a maximum rotation range in the forward rotation direction to a maximum rotation range in the reverse rotation direction in the die cushion force control process to double allowable slide speed, so that a press/slide stroke number does not need to be substantially limited. A device for this is to be a simple change for providing a "hole" (one hole) communicating with the low-pressure line 82 from the hydraulic cylinder 3 through the solenoid valve, so that an existing (already fabricated) servo die cushion device in which a servo motor is driven to transmit power using hydraulic medium can be easily modified to be able to respond to double slide speed.

In the present example, while only the one kind of orifice 52 (a hole diameter of are 4.3 mm) is used by turning on and off the solenoid valve 51, it is assumed that the orifices 52, 54 and 56 are used by timely switching the solenoid valves 51, 53, and 55 depending on die cushion pressure and slide speed (maximum slide speed).

Basically, larger working die cushion pressure reduces a working orifice diameter. That is, higher pressure increases the amount of oil flowing (released) through an orifice. It is desirable an orifice diameter is determined for each die cushion pressure such that the amount of oil released through an orifice just becomes a level equal to or less than the amount of oil pushed into from the hydraulic pump/motor 4 when the servo motor 5 rotates at its maximum rotation speed (or rotation speed close to and less than the maximum rotation speed), or such that the amount of oil released through an orifice can be compensated by the amount of oil pushed into from the hydraulic pump/motor 4 to maintain die cushion pressure when slide speed is zero.

A table of FIG. 16 illustrates die cushion force (pressure), and release flow rate and allowable maximum slide speed for each of the solenoid valves 51, 53, and 55 when turned on (1) or tuned off (0).

While in the example of the die cushion device 10-1 of the first embodiment described above, as illustrated in a row (1) of the table of FIG. 16, only the solenoid valve 51 is turned on to cause an orifice with a diameter of 4.3 mm to work in accordance with a die cushion setting pressure of 240.4 kg/cm$^2$ to be able to respond to a slide speed (maximum slide speed at the time when die cushion starts) of 600 mm/s, it is preferable that turning on and off of the solenoid valves 51, 53, and 55 (orifice diameter) is determined on the basis of a setting value of die cushion force (pressure) and the like, as illustrated in rows (1) to (12) in the table of FIG. 16.

As illustrated in the rows (2) and (3) in the table of FIG. 16, even if working die cushion pressure decreases to 220.4 kg/cm$^2$ (row (2)), or to 200.4 kg/cm$^2$ (row (3)), it is possible to respond to a slide speed of 600 mm/s by turning on only the solenoid valve 51 (action of the orifice with a diameter of 4.3 mm).

However, as illustrated in the row (4) in the table of FIG. 16, when working die cushion pressure decreases to 180.4 kg/cm$^2$ (row (4)), the amount of oil released through an orifice to maintain a slide speed of 600 mm/s cannot be secured by turning on only the solenoid valve 51 (action of an orifice with a hole diameter of 4.3 mm). Thus, the solenoid valve 53 is simultaneously turned on together with the solenoid valve 51 to cause an orifice 54 with a hole diameter of 1.0 mm to work.

In addition, as illustrated in the row (5) in the table of FIG. 16, when working die cushion pressure decreases to 160.4 kg/cm$^2$ (row (5)), the amount of oil released through the orifices 52 and 54 to maintain a slide speed of 600 mm/s cannot be secured by turning on only the solenoid valves 51 and 53 (action of each of the orifice 52 with a hole diameter of 4.3 mm and the orifice 54 with a hole diameter of 1.0 mm). Thus, the solenoid valve 55 instead of the solenoid valve 53 is simultaneously turned on together with the solenoid valve 51 to cause the orifice 52 with a hole diameter of 4.3 mm and the orifice 56 with a hole diameter of 2.0 min to work.

Further, as illustrated in the row (7) in the table of FIG. 16, when working die cushion pressure decreases to 120.4 kg/cm$^2$ (row (7)), the amount of oil released through the orifices to maintain a slide speed of 600 mm/s cannot be secured by turning on only the solenoid valves 51 and 55 (action of each of the orifice 52 with a hole diameter of 4.3 mm and the orifice 56 with a hole diameter of 2 mm). Thus, as illustrated in the row (7) in the table, the solenoid valves 51, 53, and 55 are simultaneously turned on to cause the orifice 52 with a hole diameter of 4.3 mm, the orifice 54 with a hole diameter of 1.0 mm, and the orifice 56 with a hole diameter of 2.0 mm to work. Nevertheless, the amount of oil released is insufficient when slide speed is 600 mm/s, so that responding slide speed is limited to 590 mm/s.

Furthermore, as illustrated in the rows (8) to (12) in the table of FIG. 16, when working die cushion pressure decreases to about 100 kg/cm$^2$ or less, action modes of orifice diameters are limited to four patterns according to combinations of turning on and off of the solenoid valves 51, 53, and 55 in the present example because the solenoid valve 51 is basically always turned on. Thus, allowable maximum slide speed decreases in accordance with the amount of oil when the solenoid valves 51, 53, and 55 are used in combination with each other, or when a total amount of oil released through the orifices becomes maximum. Nevertheless, the allowable maximum slide speed is larger than conventional allowable maximum slide (300 mm/s) when no orifice is provided, and thus, even when 10% or less of the maximum die cushion pressure of 20.4 kg/cm$^2$ acts, the allowable maximum slide speed is 430 mm/s.

In the present example, while the three solenoid valves 51, 53, and 55 are provided with three orifices 52 with a hole diameter of 4.3 mm, 54 with a hole diameter of 1.0 mm, and 56 with a hole diameter of 2.0 mm, respectively, the number of solenoid valves (orifices) as well as a diameter of an orifice, to be used, is not limited. It is desirable to increase the number of solenoid valves, or the number of patterns of throttle opening formed by an orifice, so that lower die cushion pressure does not cause allowable maximum slide speed to decrease.

In the present example, the solenoid valve 51 and the orifice 52 with a hole diameter of 4.3 mm, capable of responding to a maximum die cushion pressure of 240.4 kg/cm$^2$ and a slide speed of 600 mm/s, are provided for basic function, and the orifices 54 with a hole diameter of 1.0 mm and 56 with a hole diameter of 2.0 mm for fine adjustment are provided to secure the amount of oil that is released through the orifices while gradually increasing ever time when die cushion pressure (setting) decreases. Then, the solenoid valves 53 and 55 are configured to be turned on and off to combine the orifice 52 with a basic diameter of 4.3 mm, and the orifices 54 and 56 for fine adjustment, with each other, so that four patterns of diameter, such as a basic diameter of 4.3 mm, 3 mm+1.0 mm, 4.3 mm+2.0 mm, and 4.3 mm+1.0 mm+2.0 mm, are available. While only one solenoid valve (and one orifice diameter) may work in accordance with die cushion pressure and slide speed (allowable maximum slide speed), this is inefficient because the number of solenoid valves increases as compared with the present example. For example, when there are provided four patterns of a solenoid valve A (with an orifice having a hole diameter of 4.3 mm), a solenoid valve B (with an orifice having a hole diameter of 4.4 mm), a solenoid valve C (with an orifice having a hole diameter of 4.7 mm), and a solenoid valve D (with an orifice having a hole diameter of 4.8 mm), the solenoid valve A can be turned on in the case of the rows (1) to (3) in the table illustrated in FIG. 16, the solenoid valve B can be turned on in the case of the row (4) therein, the solenoid valve C can be turned on in the case of each of the rows (5) and (6) therein, and the solenoid valve D can be caused to work in the case of each of the rows (7) to (12) therein. However, the number of solenoid valves increases by one, thereby to be inefficient.

While die cushion pressure (corresponding to die cushion force) is controlled to be always uniform during the die cushion force control process in the present example, it is also assumed (in the present invention) that when pressure is changed during the die cushion force control process (die cushion stroke), a solenoid valve (orifice diameter) is changed during the die cushion force control process (die cushion stroke) depending on a level of change in pressure (die cushion pressure after change in pressure).

For example, when a die cushion pressure of 120.4 kg/cm$^2$ is first applied at the time when die cushion force control starts, all of the solenoid valves 51, 53, and 55 are turned on according to the row (7) in the table. Meanwhile, when the die cushion pressure is changed to 240.4 kg/cm$^2$ in the middle of a die cushion stroke, the solenoid valves 53 and 55 are turned off while only the solenoid valve 51 is continuously turned on at the time when the die cushion pressure is changed on the basis of a slide position signal. The time is a time of change in pressure, and it is also assumed to suitably change the time depending on response time of turning-on of a solenoid valve to be used. When the solenoid valves 53 and 55 are tuned off, a total amount of oil released through all orifices required to maintain die cushion pressure (240.4 kg/cm$^2$) is maintained within a range of the amount of oil pushed into (supplied) from the hydraulic pump/motor 4 when the servo motor 5 rotates at its maximum rotation speed. Otherwise (if the solenoid valves 53 and 55 are not turned off), the amount of oil released through the orifices is to be at least about 153 l/min at the press bottom dead center according to Expression 4 (by totaling the amount of oil that is calculated for each of orifice diameters of 4.3 mm, 1.0 mm, and 2.0 mm using Expression 4), so that the amount of oil released through the orifices exceeds the range (120 l/min) of the amount of oil pushed into (supplied) from the hydraulic pump/motor 4 when the servo motor 5 rotates at its maximum rotation speed, and thus the die cushion pressure (240.4 kg/cm$^2$) cannot be maintained.

In addition, for example (contrary to the description above), when a die cushion pressure of 240.4 kg/cm$^2$ is first applied at the time when die cushion force control starts, only the solenoid valves 51 is turned on according to the row (1) in the table illustrated in FIG. 16. Meanwhile, when the die cushion pressure is changed (reduced) to 120.4 kg/cm$^2$ in the middle of a die cushion stroke (at a stroke of 20 mm after a half of the die cushion stroke), the solenoid valves 53 and 55 do not need to be turned on at the time. That is, at the time, slide speed decreases to 300 mm/s or less, and the amount of oil released through an orifice required to maintain the die cushion pressure (120.4 kg/cm$^2$) by action of only the solenoid valve 51 is to be about 85 l/min according to Expression 4 (by calculating the amount of oil when an orifice diameter is 4.3 mm using Expression 4), so that the amount of oil released through the orifice is equal to or less than 120 l/min of the amount of oil pushed into (supplied) from the hydraulic pump/motor 4 when the servo motor 5 rotates at its maximum rotation speed, and thus the die cushion pressure (120.4 kg/cm$^2$) can be maintained without changing action of a solenoid valve.

In addition, it is also assumed to use a manual throttle valve (refer to FIG. 19) instead of an orifice in the present invention. The amount of oil released through an orifice cannot be (finely) adjusted for die cushion pressure in an orifice with a fixed diameter (there is no method of changing the amount of oil released through an orifice for die cushion pressure instead of changing an orifice diameter, thereby causing adjustment to be difficult). Meanwhile, when a manual throttle valve is used, the amount of oil released from the manual throttle valve can easily (finely) adjusted for die cushion pressure. The amount of oil is experimentally adjusted, and a throttle amount corresponding to a desirable orifice hole diameter can be fixed after the adjustment.

In addition, it is also assumed to use a proportion flow control valve (refer to FIG. 21) instead of an orifice in the present invention. When a proportion flow control valve is used, the number of valves can be reduced to reduce an occupied space (installation space) in a hydraulic device. Then, valve opening (corresponding to an orifice diameter) suitable for die cushion pressure and slide speed (maximum slide speed) can be steplessly adjusted. Further, an orifice diameter may be relatively small as illustrated in the die cushion device 10-1 of the first embodiment, so that when an orifice is substituted with a proportion flow control valve, a relatively small amount of oil may be compensated and no pilot pressure is required (there is required no method of controlling pilot pressure by using a proportion flow control valve with a smaller capacity for pilot drive to drive a proportion flow control valve with a larger capacity), and thus a proportion flow rate valve of a direct driving type at low cost with high responsivity is available.

Second Embodiment

Figure 17:
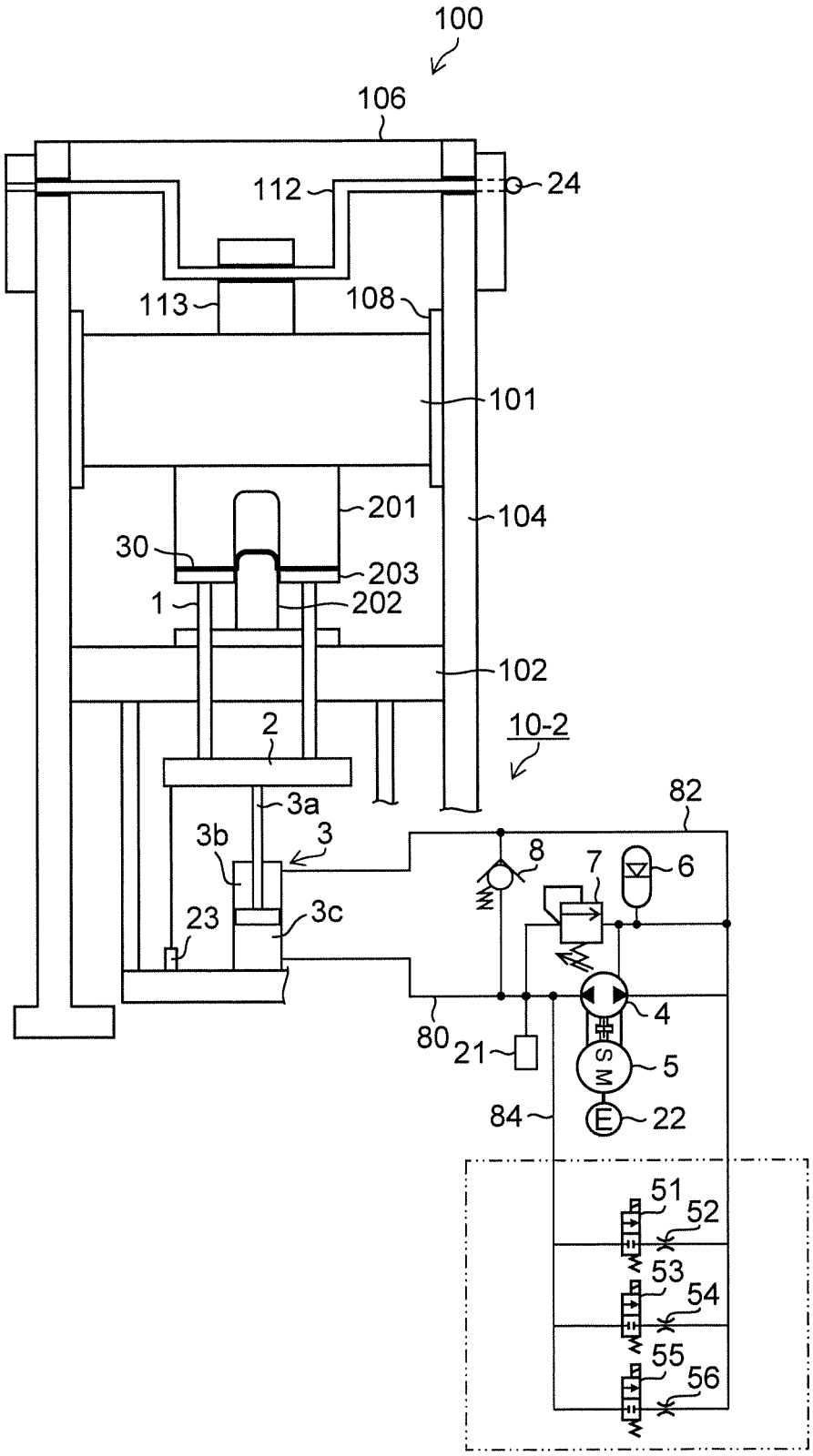
FIG. 17 is a structural view illustrating a die cushion device of a press machine of a second embodiment according to the present invention.

FIG. 17 is a structural view illustrating a die cushion device of a press machine of a second embodiment according to the present invention. In FIG. 17, a component in common with the die cushion device 10-1 of the first embodiment illustrated in FIG. 4 is designated by the same reference numeral to eliminate duplicated description in detail.

A die cushion device 10-2 of a second embodiment illustrated in FIG. 17 is different in that while a flow rate detector 27 is provided in a high-pressure line 84 in the die cushion device 10-1 of the first embodiment, the flow rate detector 27 is not provided in the high-pressure line 84 in the die cushion device 10-2 of the second embodiment.

This is because, a flow rate of oil released to a low-pressure source side through an orifice connected in series to a turned-on solenoid valve among solenoid valves 51, 53, and 55 is in proportion to a square root of die cushion pressure as well as to an opening area of a working orifice (throttle opening of a throttle part), according to Bernoulli's theorem (Expression 4), so that the flow rate of oil released to the low-pressure source side can be calculated on the basis of die cushion pressure and an opening area of the orifice according to Bernoulli's theorem.

Figure 18:
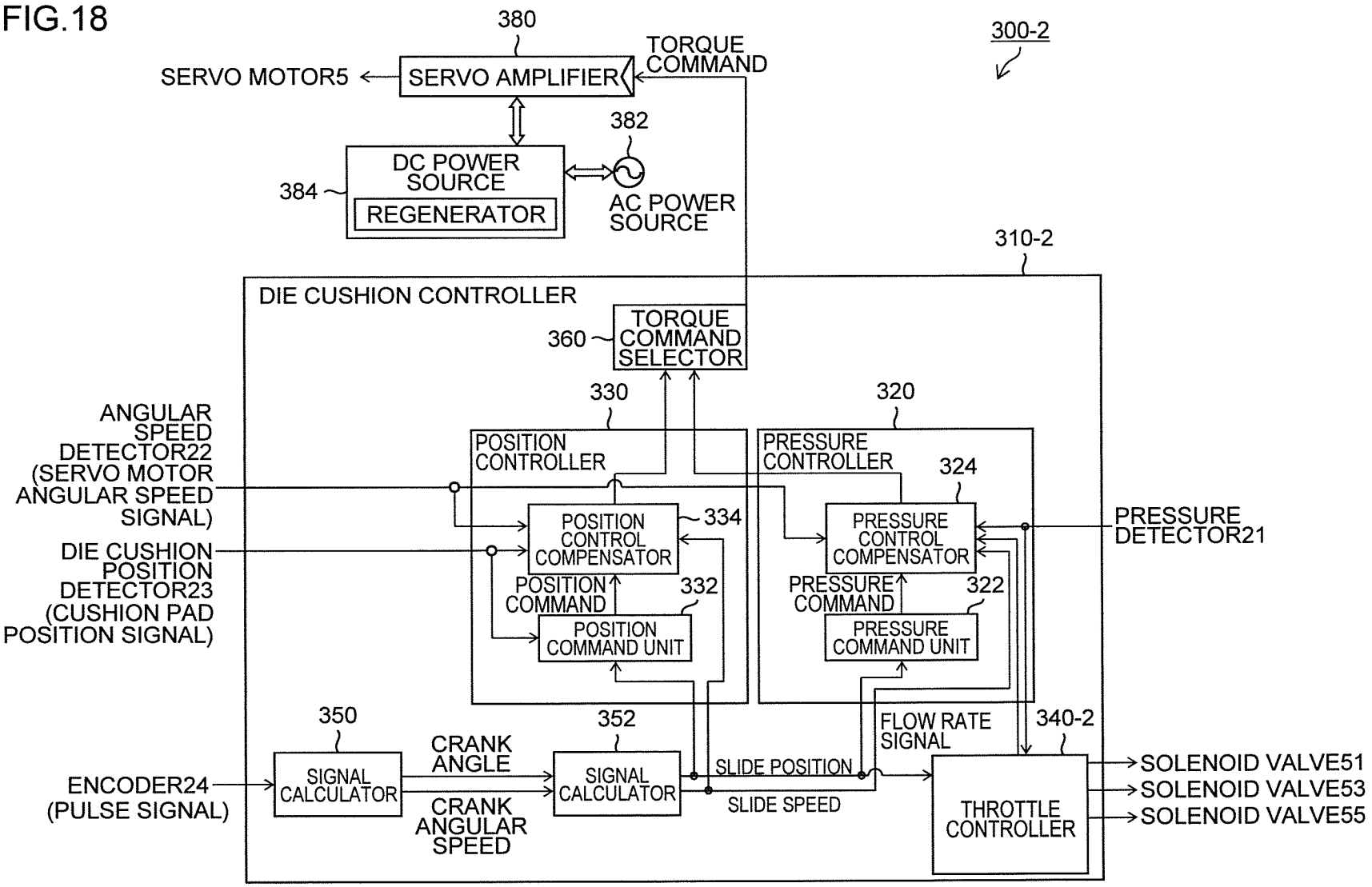
FIG. 18 is a block diagram illustrating an embodiment of a control unit in the die cushion device of the second embodiment illustrated in FIG. 17.

FIG. 18 is a block diagram illustrating an embodiment of a control unit 300-2 in the die cushion device 10-2 of the second embodiment illustrated in FIG. 17. In FIG. 18, a component in common with the control unit 300-1 in the die cushion device 10-1 of the first embodiment illustrated in FIG. 5 is designated by the same reference numeral to eliminate duplicated description in detail.

The control unit 300-2 illustrated in FIG. 18 includes a die cushion controller 310-2 that is different from the die cushion controller 310-1 illustrated in FIG. 5, particularly a throttle controller 340-2 in the die cushion controller 310-2 is different from the throttle controller 340 illustrated in FIG. 5, and other configurations are in common with those of the control unit 300-1.

While the throttle controller 340-2 controls turning on and off of solenoid valves 51, 53, and 55, as with the throttle controller 340 illustrated in FIG. 5, the throttle controller 340-2 further calculates a flow rate of oil to be released to the low-pressure source side through an orifice on the basis of an opening area of the orifice connected to a turned-on solenoid valve (when a plurality of solenoid valves is turned on, an opening area of each of a plurality of orifices connected to the corresponding plurality of solenoid valves is totaled) and die cushion pressure according to Bernoulli's theorem. Detection output from a pressure detector 21 can be used for the die cushion pressure.

The throttle controller 340-2 receives a pressure signal, and outputs a flow rate signal indicating a calculated flow rate to a pressure controller 320 (a pressure control compensator 324).

Third Embodiment

Figure 19:
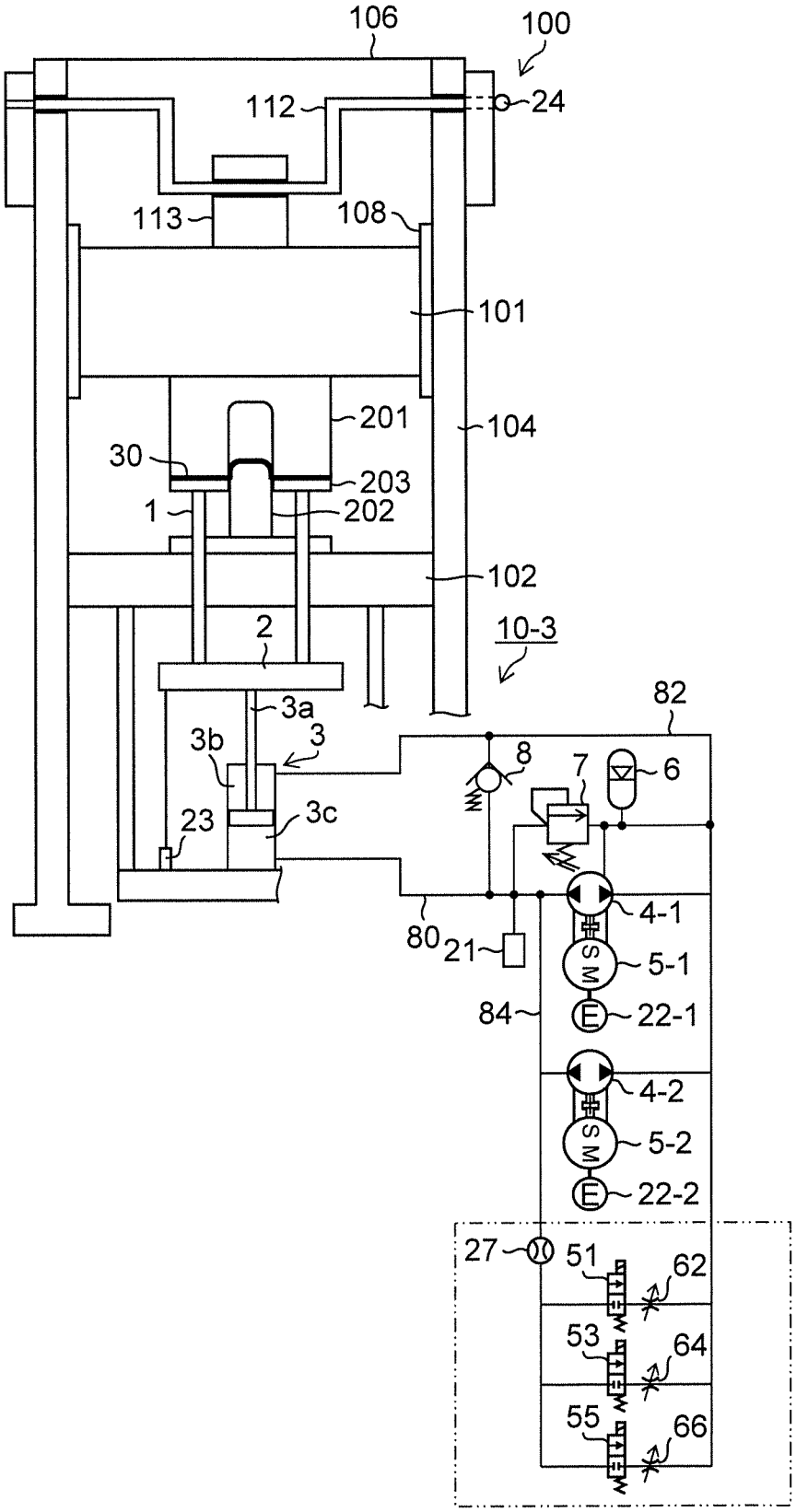
FIG. 19 is a structural view illustrating a die cushion device of a press machine of a third embodiment according to the present invention.

FIG. 19 is a structural view illustrating a die cushion device of a press machine of a third embodiment according to the present invention. In FIG. 19, a component in common with the die cushion device 10-1 of the first embodiment illustrated in FIG. 4 is designated by the same reference numeral to eliminate duplicated description in detail.

A die cushion device 10-3 of the third embodiment illustrated in FIG. 19 is different from the die cushion device 10-1 of the first embodiment in that two hydraulic pump/motors 4-1 and 4-2 are provided in parallel between a high-pressure line 84 and a low-pressure line 82, and the hydraulic pump/motors 4-1 and 4-2 includes servo motors 5-1 and 5-2, and angular speed detectors 22-1 and 22-2, respectively, and in that manual throttle valves 62, 64, and 66 are provided instead of orifices 52, 54 and 56.

When two pairs of a hydraulic pump/motor and a servo motor are provided in parallel between the high-pressure line 84 and the low-pressure line 82, it is possible to respond to control of a double flow rate as compared with a pair of a hydraulic pump/motor and a servo motor.

In addition, when the throttle valves (manual throttle valve) 62, 64, and 66 are provided instead of orifices, it is possible to (finely) adjust a flow rate of oil to be released through throttle each of the throttle valves 62, 64, and 66 for die cushion pressure.

It is preferable that a flow rate of oil released through each of the throttle valves 62, 64, and 66 is to be a minimum to reduce pressure loss in each of the throttle valves 62, 64, and 66. Conversely, it is preferable that a flow rate of oil when a hydraulic pump/motor (and a servo motor) is caused to serve as a motor is to be a maximum to regenerate energy used for die cushioning action as electric energy.

Figure 20:
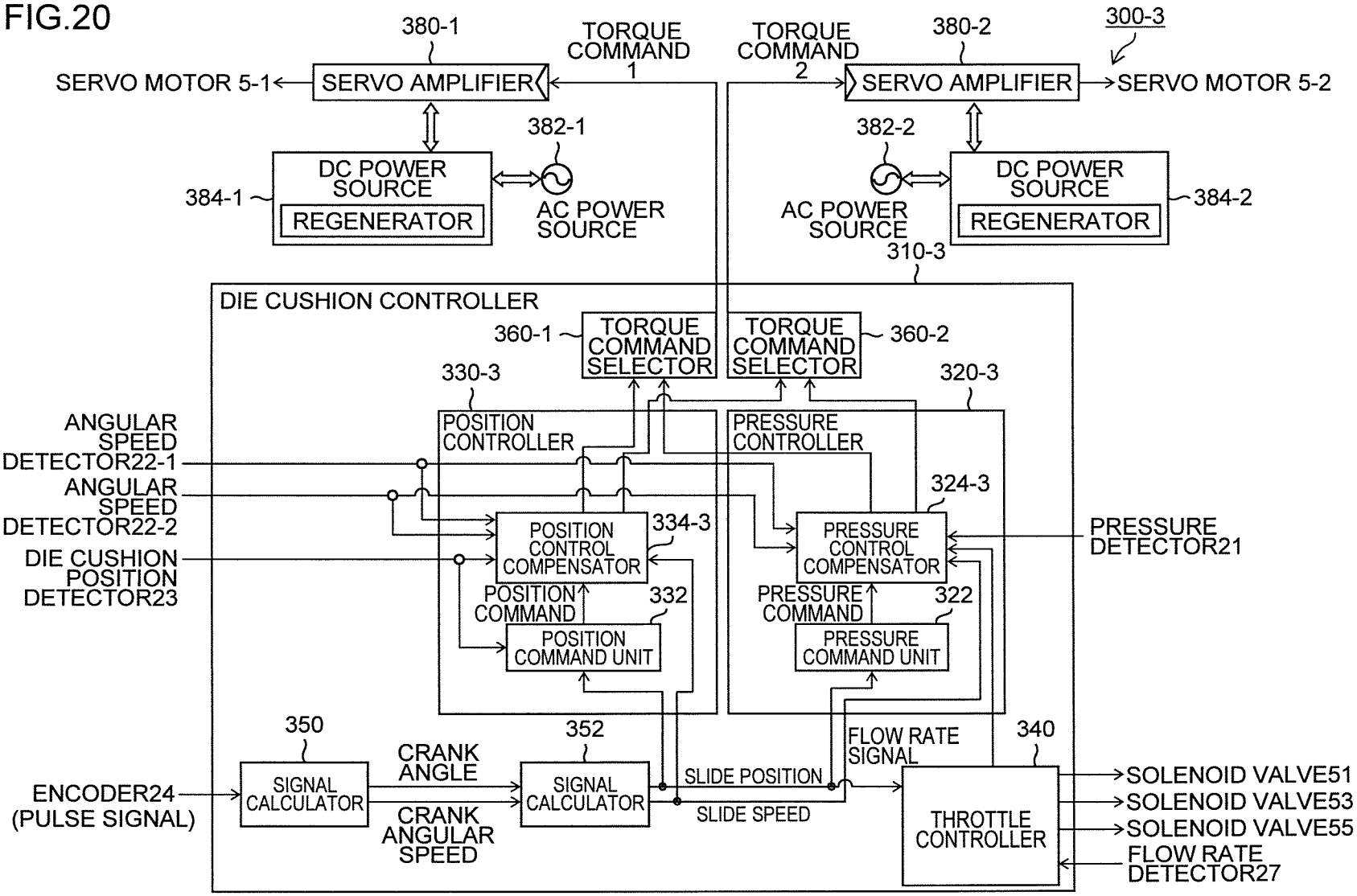
FIG. 20 is a block diagram illustrating an embodiment of a control unit in the die cushion device of the third embodiment illustrated in FIG. 19.

FIG. 20 is a block diagram illustrating an embodiment of a control unit 300-3 in the die cushion device 10-3 of the third embodiment illustrated in FIG. 19. In FIG. 20, a component in common with the control unit 300-1 in the die cushion device 10-1 of the first embodiment illustrated in FIG. 5 is designated by the same reference numeral to eliminate duplicated description in detail.

The control unit 300-3 illustrated in FIG. 20 is different from the control unit 300-1 that controls one servo motor 5 (refer to FIG. 5) in that the two servo motors 5-1 and 5-2 are configured to be independently controlled.

That is, the control unit 300-3 illustrated in FIG. 20 mainly includes a die cushion controller 310-3, servo amplifiers 380-1 and 380-2 each including a PWM controller, AC power sources 382-1 and 382-2, and DC power sources 384-1 and 384-2 each having an electric power regenerative function. The AC power sources 382-1 and 382-2 may be in common with each other.

The die cushion controller 310-3 includes a pressure controller 320-3 provided with a die cushion pressure command unit 322 and with a pressure control compensator 324-3, a position controller 330-3 provided with a die cushion position command unit 332 and with a position control compensator 334-3, a throttle controller 340, signal calculators 350 and 352, and a torque command selectors 360-1 and 360-2.

The pressure control compensators 324-3 receives a die cushion pressure command signal, a die cushion pressure signal, a slide speed signal, and a flow rate signal, and also receives servo motor angular speed signals (independence servo motor angular speed signals) indicating the corresponding angular speeds of the servo motors 5-1 and 5-2 detected by the angular speed detectors 22-1 and 22-2, respectively. In a die cushion pressure control state, the pressure control compensator 324-3 creates torque command signals on the basis of the signals to drive the corresponding servo motors 5-1 and 5-2. The torque command signal created for the servo motor 5-1 is output to the torque command selector 360-1, and the torque command signal created for the servo motor 5-2 is output to the torque command selector 360-2.

The position control compensator 334-3 receives a die cushion position command signal, a die cushion position signal, and a slide speed signal, and also receives servo motor angular speed signals indicating the corresponding angular speeds of the servo motors 5-1 and 5-2 detected by the angular speed detectors 22-1 and 22-2, respectively. In a die cushion position control state, the position control compensator 334 creates torque command signals on the basis of the signals to drive the corresponding servo motors 5-1 and 5-2. The torque command signal created for the servo motor 5-1 is output to the torque command selector 360-1, and the torque command signal created for the servo motor 5-2 is output to the torque command selector 360-2.

The torque command selectors 360-1 and 360-2 receive the corresponding torque command signals created by the pressure controller 320-3, the torque command signals corresponding to the respective servo motors 5-1 and 5-2, or receive the corresponding torque command signals created by the position controller 330-3, the torque command signals corresponding to the respective servo motors 5-1 and 5-2. When a slide 101 is positioned in a forming process region, the torque command selectors 360-1 and 360-2 select the corresponding torque command signals created by the pressure controller 320-3, and output them to the corresponding servo amplifiers 380-1 and 380-2. When the slide 101 is positioned in a non-forming process region, the torque command selectors 360-1 and 360-2 select the corresponding torque command signals created by the position controller 330-3, and output them to the corresponding servo amplifiers 380-1 and 380-2.

Fourth Embodiment

Figure 21:
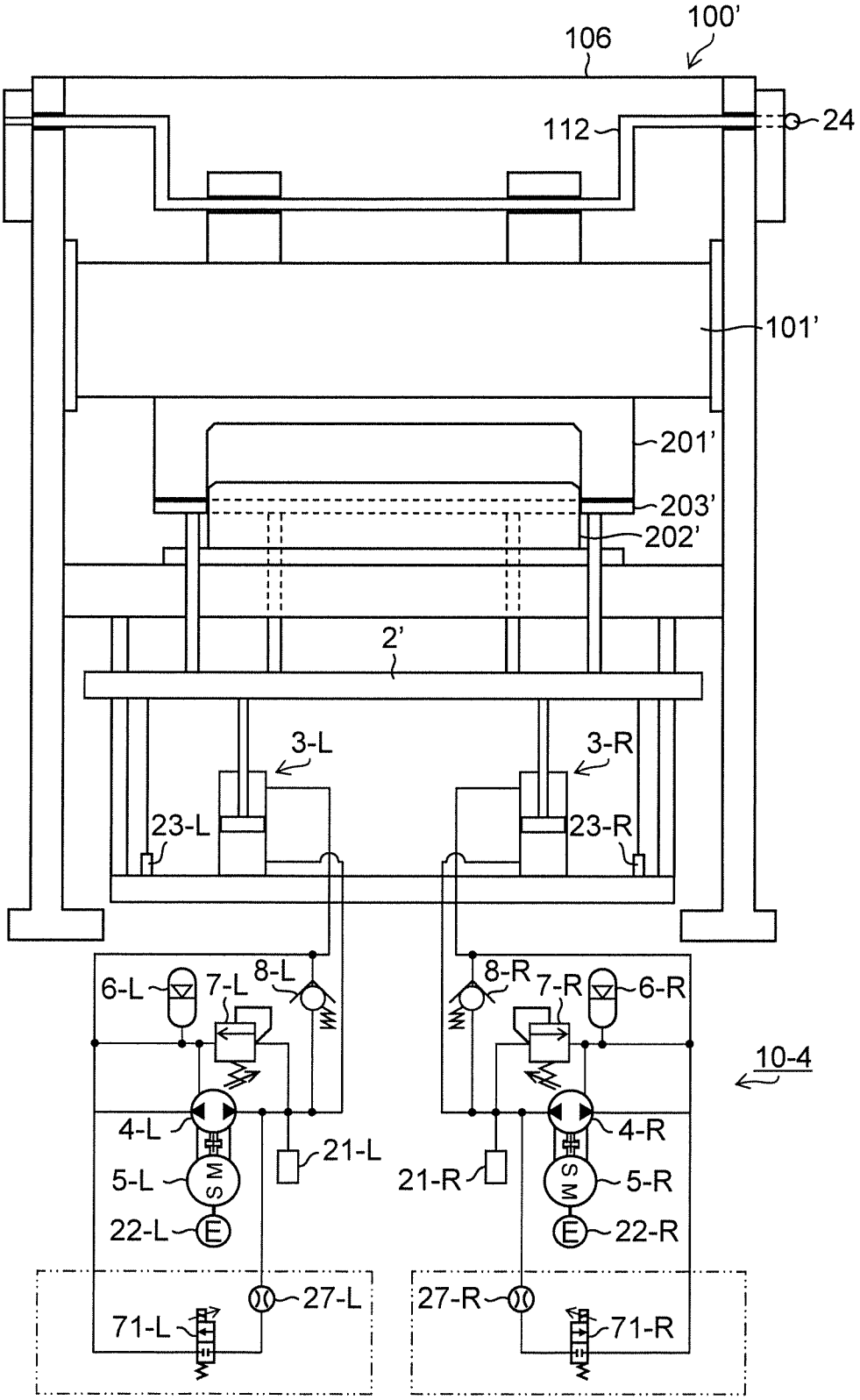
FIG. 21 is a structural view illustrating a die cushion device of a press machine of a fourth embodiment according to the present invention.

FIG. 21 is a structural view illustrating a die cushion device of a press machine of a fourth embodiment according to the present invention. In FIG. 21, a component in common with the die cushion device 10-1 of the first embodiment illustrated in FIG. 4 is designated by the same reference numeral to eliminate duplicated description in detail.

A press machine 100' illustrated in FIG. 21 is different from the press machine 100 illustrated in FIG. 4 in a slide 101' and dies (an upper die 201' and a lower die 202'), for example, and is increased in size. A die cushion device 10-4 of the fourth embodiment illustrated in FIG. 21 includes a cushion pad 2', a blank holding plate 203', and the like, which are large, corresponding to the press machine 100' increased in size. As a result, the die cushion device 10-4 includes a left-and-right pair of hydraulic cylinders 3-L and 3-R that support the cushion pad 2'. The two hydraulic cylinders 3-L and 3-R respectively include hydraulic pump/motors 4-L and 4-R, servo motors 5-L and 5-R, accumulators 6-L and 6-R, relief valves 7-L and 7-R, check valves 8-L and 8-R, pressure detectors 21-L and 21-R, angular speed detectors 22-L and 22-R, die cushion position detectors 23-L and 23-R, flow rate detectors 27-L and 27-R, and proportion flow control valves 71-L and 71-R.

Two hydraulic circuits respectively including the left-and-right pair of hydraulic cylinders 3-L and 3-R, the hydraulic pump/motors 4-L and 4-R, and the like, are independent right and left. While the hydraulic circuits are different from the hydraulic circuit illustrated in FIG. 4 in that the proportion flow control valves 71-L and 71-R are provided instead of the solenoid valves 51, 53, and 55, and the orifices 52, 54 and 56, illustrated in FIG. 4, other configurations are identical.

In the case of the die cushion device 10-4 configured as described above, die cushion pressure applied to each of the hydraulic cylinders 3-L and 3-R can be individually controlled, so that die cushion pressure corresponding to each of right and left shapes of the cushion pad 2' can be generated.

In addition, the die cushion device 10-4 of the fourth embodiment illustrated in FIG. 21 includes the proportion flow control valve 71-L, 71-R instead of the solenoid valves 51, 53, and 55, and the orifices 52, 54 and 56, illustrated in FIG. 4, so that no solenoid valve is needed and throttle opening (opening area) can be steplessly adjusted, and thus throttle opening suitable for die cushion force (pressure) to be set can be achieved.

While the die cushion device 10-4 of the fourth embodiment illustrated in FIG. 21 includes two hydraulic cylinders 3-L and 3-R, and the two hydraulic circuits, three or more hydraulic cylinders and hydraulic circuits may be provided.

Figure 22:
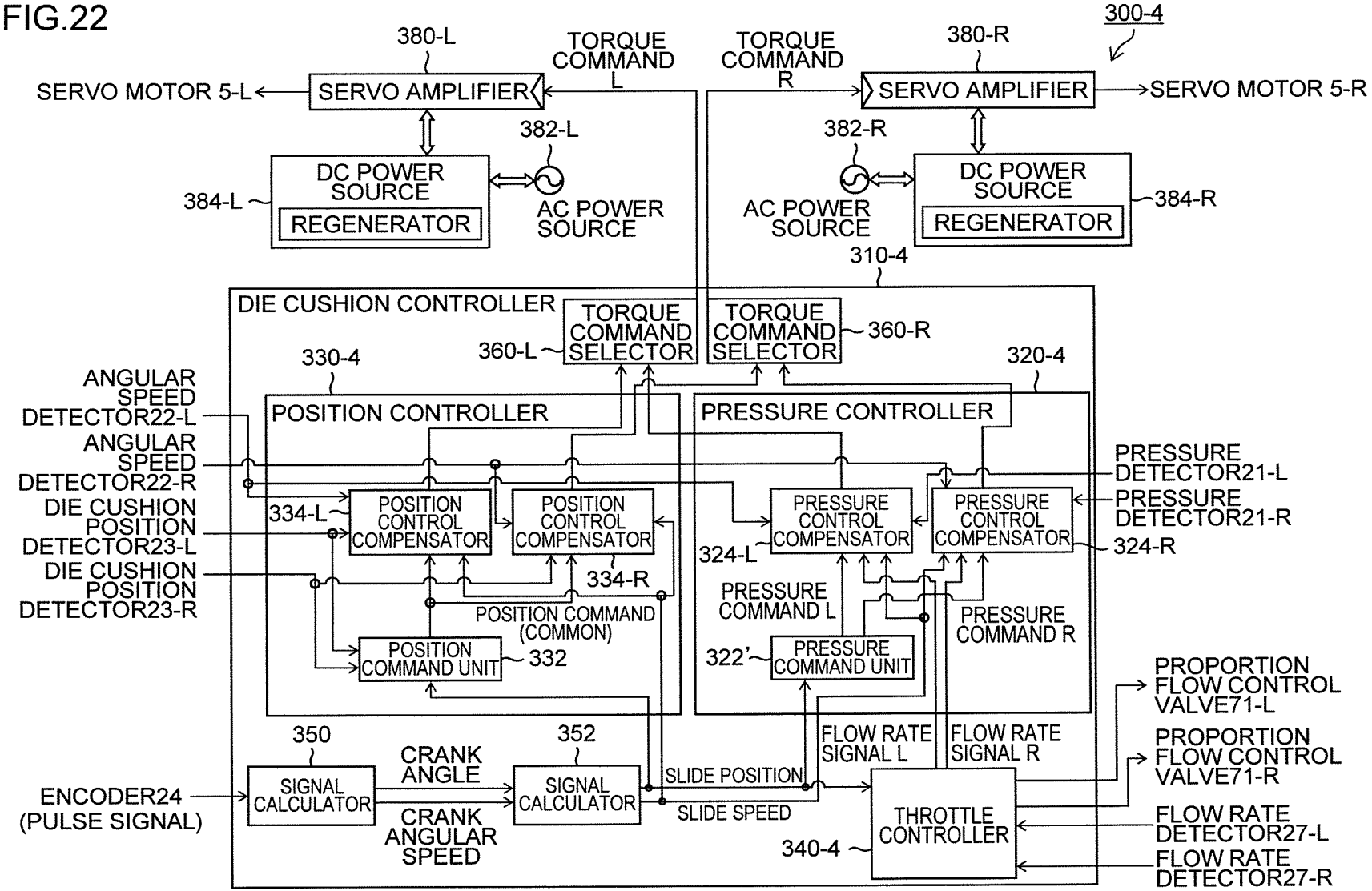
FIG. 22 is a block diagram illustrating an embodiment of a control unit in the die cushion device of the fourth embodiment illustrated in FIG. 21.

FIG. 22 is a block diagram illustrating an embodiment of a control unit 300-4 in the die cushion device 10-4 of the fourth embodiment illustrated in FIG. 21. In FIG. 22, a component in common with the control unit 300-1 in the die cushion device 10-1 of the first embodiment illustrated in FIG. 5 is designated by the same reference numeral to eliminate duplicated description in detail.

The control unit 300-4 illustrated in FIG. 22 is different from the control unit 300-1 that controls one servo motor 5 (refer to FIG. 5) in that the two servo motors 5-L and 5-R are configured to be independently controlled.

That is, the control unit 300-4 illustrated in FIG. 22 mainly includes a die cushion controller 310-4, servo amplifiers 380-L and 380-R each including a PWM controller, AC power sources 382-L and 382-R, and DC power sources 384-L and 384-R each having an electric power regenerative function. The AC power sources 382-L and 382-R may be in common with each other.

The die cushion controller 310-4 includes a pressure controller 320-4 provided with a die cushion pressure command unit 322' and with pressure control compensators 324-L and 324-R, a position controller 330-4 provided with a die cushion position command unit 332 and with position control compensators 334-L and 334-R, a throttle controller 340-4, signal calculators 350 and 352, and a torque command selectors 360-L and 360-R.

The die cushion pressure command unit 322' outputs individual die cushion pressure command signals to the pressure control compensators 324-L and 324-R for the corresponding hydraulic cylinders 3-L and 3-R.

In a die cushion pressure control state, the pressure control compensator 324-L creates a torque command signal to drive the servo motor 5-L on the basis of a die cushion pressure command signal, a signal of die cushion pressure detected by the pressure detector 21-L, a slide speed signal, a signal of a flow rate detected by the flow rate detector 27-L, and a signal of servo motor angular speed detected by the angular speed detector 22-L, which are received. That is, the pressure control compensator 324-L creates a torque command signal by using a die cushion pressure signal received from the pressure detector 21-L as a pressure feedback signal to control die cushion pressure as indicated by the die cushion pressure command signal on a hydraulic cylinder 3-L side, received from the die cushion pressure command unit 322'. A servo motor angular speed signal is used as a feedback or feedforward signal to secure dynamic stability of die cushion pressure, and a slide speed signal and a flow rate signal each are used as a feedback or feedforward signal to improve control accuracy of die cushion pressure.

Likewise, the pressure control compensator 324-R creates a torque command signal to drive the servo motor 5-R on the basis of a die cushion pressure command signal, a signal of die cushion pressure detected by the pressure detector 21-R, a slide speed signal, a signal of a flow rate detected by the flow rate detector 27-R, and a signal of servo motor angular speed detected by the angular speed detector 22-R, which are received.

A torque command signal created by the pressure control compensator 324-L for the servo motor 5-L is output to the torque command selector 360-L, and a torque command signal created by the pressure control compensator 324-R for the servo motor 5-R is output to the torque command selector 360-R.

Meanwhile, the die cushion position command unit 332 of the position controller 330-4 outputs a die cushion position command signal to control a die cushion position (position of the cushion pad 2') to each of the position control compensators 334-L and 334-R. The cushion pad 2' is controlled in position while being maintained parallel to itself, so that a common die cushion position command signal is used for the hydraulic cylinders 3-L and 3-R.

The position control compensator 334-L receives a die cushion position signal indicating a position of the left side of the cushion pad 2', detected by the die cushion position detector 23-L, a servo motor angular speed signal indicating angular speed of the servo motor 5-L, detected by the angular speed detector 22-L, and a slide speed signal, along with the die cushion position command signal. In a die cushion position control state, the position control compensator 334-L creates a torque command signal to drive the servo motor 5-L on the basis of the signals.

Likewise, the position control compensator 334-R receives a die cushion position signal indicating a position of the right side of the cushion pad 2', detected by the die cushion position detector 23-R, a servo motor angular speed signal indicating angular speed of the servo motor 5-R, detected by the angular speed detector 22-R, and a slide speed signal, along with the die cushion position command signal. In a die cushion position control state, the position control compensator 334-R creates a torque command signal to drive the servo motor 5-R on the basis of the signals.

A torque command signal created by the position control compensator 334-L for the servo motor 5-L is output to the torque command selector 360-L, and a torque command signal created by the position control compensator 334-R for the servo motor 5-R is output to the torque command selector 360-R.

The throttle controller 340-4 receives a slide position signal from the signal calculator 352, and the throttle controller 340-4 then outputs a command signal to command valve opening of each of the proportion flow control valves 71-L and 71-R, on the basis of the slide position signal.

It is preferable that the throttle controller 340-4 outputs a command signal to cause the valve opening to be zero in a die cushion position control state, and that the throttle controller 340-4 outputs a command signal to command valve opening suitable for a maximum slide speed and a die cushion pressure command signal set by the die cushion pressure command unit 322' in a die cushion pressure control state.

The throttle controller 340-4 outputs a command signal to command valve opening suitable for a set die cushion pressure command signal instead of controlling valve opening of each of the proportion flow control valves 71-L and 71-R to control die cushion force (pressure). For example, in the case of operation with a slide stroke number in which all of the amount of oil pushed away from a lower chamber of a hydraulic cylinder cannot be released to a low-pressure source through a hydraulic pump/motor, it is preferable that when a set die cushion pressure command signal that is uniform, the throttle controller 340-4 outputs a command signal to command uniform valve opening corresponding to the uniform die cushion pressure command signal, and it is preferable that when a set die cushion pressure command signal changes stepwise, the throttle controller 340-4 outputs a command signal to command valve opening that changes stepwise, corresponding to the die cushion pressure command signal that changes stepwise.

When different die cushion pressure is set to each of the right and left hydraulic cylinders 3-L and 3-R, it is preferable that the throttle controller 340-4 outputs a different command signal corresponding to the set die cushion pressure to each of the proportion flow control valves 71-L and 71-R.

The torque command selectors 360-L and 360-R receive the corresponding torque command signals created by the pressure controller 320-4, the torque command signals corresponding to the respective servo motors 5-L and 5-R, or receive the corresponding torque command signals created by the position controller 330-4, the torque command signals corresponding to the respective servo motors 5-L and 5-R. When a slide 101' is positioned in a forming process region, the torque command selectors 360-L and 360-R select the corresponding torque command signals created by the pressure controller 320-4, and output them to the corresponding servo amplifiers 380-L and 380-R. When the slide 101' is positioned in a non-forming process region, the torque command selectors 360-L and 360-R select the corresponding torque command signals created by the position controller 330-4, and output them to the corresponding servo amplifiers 380-L and 380-R.

[Others]

When all of the amount of oil pushed away from a lower chamber of a hydraulic cylinder can be released to a low-pressure source through a hydraulic pump/motor under conditions where a maximum slide speed of a press slide is a predetermined speed or less (e.g., when a press machine is driven at a slide stroke number of 30 spm as illustrated in FIG. 6), it is preferable to fully close throttle opening of a throttle part (all solenoid valves are turned off, or valve opening of a proportion flow control valve is set to zero) even in a die cushion pressure control state. This is because, the hydraulic pump/motor serves as a hydraulic motor when the amount of oil pushed away from the lower chamber of the hydraulic cylinder is released to the low-pressure source through the hydraulic pump/motor, and the servo motor is rotated as a generator when rotating shaft torque generated in the hydraulic pump/motor becomes equal to driving torque of the servo motor, so that energy used for die cushioning action can be regenerated as electric energy.

In addition, the present invention is not limited the die cushion device of each of the first to fourth embodiments, and thus it is needless to say that components of the die cushion device of each of the first to fourth embodiments may be appropriately combined with each other, or various modifications and variations may be made within a range without departing from the essence of the present invention.

In the present embodiment, while the die cushion device in which oil is used for operation fluid is described, besides this, water or another liquid may be used. That is, while a form of using a hydraulic cylinder and a hydraulic pump/motor, using oil, is described in the present embodiment, the present invention is not limited to the form. Thus, it is needless to say that a hydraulic cylinder and a hydraulic pump/motor, using water or another liquid, are available in the present invention.

What is claimed is:

1. A die cushion device of a press machine, comprising:

a first hydraulic cylinder that supports a cushion pad and, while a slide of a press machine descends, generates die cushion force due to pressure in a lower chamber of the first hydraulic cylinder;

a first throttle part and a first hydraulic pump/motor that are connected to each other in parallel between the lower chamber of the first hydraulic cylinder and a low-pressure source;

a first electric motor connected to a rotating shaft of the first hydraulic pump/motor; and a control unit that controls, to generate the die cushion force, torque of the first electric motor to control the pressure in the lower chamber of the first hydraulic cylinder using hydraulic fluid, and does not control an opening of the first throttle part, wherein while the cushion pad is being pressed down by the slide, the hydraulic cylinder discharges hydraulic fluid from the lower chamber toward the first throttle part and the first hydraulic pump/motor, wherein the first throttle part is configured to be maintained open during an entire process for the control unit to control the torque of the first electric motor to generate the die cushion force, the first throttle part allowing the hydraulic fluid from the first hydraulic cylinder to flow toward the low-pressure source, wherein the control unit controls the torque of the first electric motor so that a rotation direction of the first electric motor controlled in torque by the control unit switches from a first rotation direction in which the first hydraulic pump/motor serves as a hydraulic motor to a second rotation direction in which the first hydraulic pump/motor serves as a hydraulic pump, wherein the first electric motor rotates in the first rotation direction, when a first amount of the hydraulic fluid is discharged from the first hydraulic cylinder, to allow the hydraulic fluid from the first hydraulic cylinder to flow toward the low-pressure source, wherein the first electric motor rotates in the second rotation direction, when a second amount of the hydraulic fluid is discharged from the first hydraulic cylinder, to allow the hydraulic fluid from the first hydraulic cylinder to flow toward the first throttle part, and wherein the first amount of the hydraulic fluid is greater than the second amount of the hydraulic fluid, and the first amount of the hydraulic fluid is enough to overcome the toque of the first electric motor.

2. The die cushion device of a press machine according to claim 1, wherein when a die cushion pressure command is uniform during the entire process for the control unit to control the torque of the first electric motor to generate the die cushion force, the first throttle part has a uniform throttle opening during the generation of the die cushion force.

3. The die cushion device of a press machine according to claim 1, wherein the rotation direction of the first electric motor is switched from the first rotation direction to the second rotation direction in at least a lower half region or less in one stroke of the cushion pad until the slide reaches a bottom dead center after colliding with the cushion pad.

4. The die cushion device of a press machine according to claim 1, further comprising:

a second hydraulic cylinder supporting the cushion pad; and a second hydraulic pump/motor and a second electric motor for the second hydraulic cylinder.

5. The die cushion device of a press machine according to claim 1, wherein the first throttle part is a first orifice or a first throttle valve.

6. The die cushion device of a press machine according to claim 5, further comprising a first solenoid valve that is connected to the first orifice or the first throttle valve in series.

7. The die cushion device of a press machine according to claim 6, further comprising:

a second throttle part that is a second orifice or a second throttle valve; and a second solenoid valve that is connected to the second orifice or the second throttle valve in series, wherein the first throttle part and the second throttle part are disposed in parallel with each other between the lower chamber of the first hydraulic cylinder and the low-pressure source.

8. The die cushion device of a press machine according to claim 7, wherein the control unit causes the first and second solenoid valves to simultaneously open near a time when the control unit starts controlling the torque of the first electric motor to generate the die cushion force, and causes the opened first and second solenoid valves to simultaneously close near a time when the control unit stops controlling the torque of the first electric motor to generate the die cushion force.

9. The die cushion device of a press machine according to claim 7, wherein the control unit causes at least one of the first and second solenoid valves to open near a time when the control unit starts controlling the torque of the first electric motor to generate the die cushion force, and causes at least one of the opened first and second solenoid valves to close or at least one of the closed first and second solenoid valves to open, in accordance with change in a die cushion pressure command while the control unit controls the torque of the first electric motor to generate the die cushion force, and then causes the opened first or second solenoid valve or both to close near a time when the control unit stops controlling the torque of the first electric motor to generate the die cushion force.

10. The die cushion device of a press machine according to claim 6, wherein the control unit causes the first solenoid valve to open near a time when the control unit starts controlling the torque of the first electric motor to generate the die cushion force, and causes first the solenoid valve to close near a time when the control unit stops controlling the torque of the first electric motor to generate the die cushion force.

11. The die cushion device of a press machine according to claim 1, wherein the first throttle part includes a proportion flow control valve.

12. The die cushion device of a press machine according to claim 1, further comprising:

a pressure detector that detects pressure in the lower chamber of the first hydraulic cylinder; and a flow rate detector that directly or indirectly detects a flow rate of pressure fluid that contains a part of pressure fluid pushed away from the lower chamber of the first hydraulic cylinder, and that is released to the low-pressure source through the throttle part, wherein the control unit controls torque of the first electric motor on the basis of a die cushion pressure command, pressure detected by the pressure detector, and a flow rate detected by the flow rate detector such that die cushion pressure becomes pressure corresponding to the die cushion pressure command.

13. The die cushion device of a press machine according to claim 12, further comprising:

a slide speed detector that detects speed of the slide; and an angular speed detector that detects angular speed of the first electric motor, wherein the control unit controls torque of the first electric motor such that die cushion pressure becomes pressure corresponding to the die cushion pressure command during die cushioning action of the press machine on the basis of the die cushion pressure command, pressure detected by the pressure detector, flow rate detected by the flow rate detector, speed detected by the slide speed detector, and angular speed detected by the angular speed detector.

* * * * *